US005108220A

United States Patent [19]

Allen et al.

[11] Patent Number: 5,108,220

[45] Date of Patent: Apr. 28, 1992

[54] LIGHT WEIGHT, FAST STEERING RIDING TROWEL

[75] Inventors: J. Dewayne Allen, Paragould; Hugh L. Adams, Bassett, both of Ark.

[73] Assignee: Allen Engineering Corporation, Paragould, Ark.

[21] Appl. No.: 553,445

[22] Filed: Jul. 13, 1990

[51] Int. Cl.[5] ..... E01C 19/00; E01C 19/22

[52] U.S. Cl. ..... 404/112

[58] Field of Search ..... 404/112; 37/254; 299/1, 299/229, 37

[56] References Cited

U.S. PATENT DOCUMENTS

| | | | |
|---|---|---|---|
| 3,554,291 | 1/1971 | Rogers | 404/84 X |
| 3,564,986 | 2/1971 | Burgin | 404/84 |
| 3,936,212 | 2/1976 | Holz, Sr. et al. | 404/112 |
| 4,046,484 | 9/1977 | Holz Sr. et al. | 404/112 |
| 4,312,603 | 1/1982 | Whiteman, Jr. | 404/112 |
| 4,710,055 | 12/1987 | Maass et al. | 404/112 |
| 4,859,114 | 8/1989 | Artzberger | 404/112 |

*Primary Examiner*—Ramon S. Bitts
*Assistant Examiner*—Nancy P. Connolly
*Attorney, Agent, or Firm*—Stephen D. Carver

[57] ABSTRACT

A compact, lightweight riding trowel for finishing concrete of enhanced maneuverability. A rigid frame is supported above the concrete by a pair of downwardly projecting synchronized rotors, each of which revolves multiple blades frictionally contacting the surface. Lights attached to frame corners provide illumination. The operator manually steers with a pair of primary control levers which tilt the rotors to generate steering forces. The pitch of each rotor blade is controlled manually or electrically, and a cable-driven clutch fork system is activated to vary pitch between minimum and maximum. Each of the tiltable rotor assemblies is driven by gear boxes coupled to the motor through a flexible disk drive shaft. Each gear box is mounted to the frame underside by a pivot steering box. Parallel lever arms extending beneath the frame in a direction generally perpendicular to the biaxial plane defined by the rotors are deflected by the primary control levers. Each activates elongated torque rods coupled to the gearboxes and tilts the rotors in a plane parallel with the biaxial plane. The torque rods are generally aligned, and for leverage they are braced by a gusset and offset from that axis of rotation defined within the pivot boxes which enables one of the rotors to tilt in an arc perpendicular to the biaxial plane. One lever arm controls a torque shaft interconnected with a tertiary linkage system which tilts one rotor in a plane perpendicular to the biaxial plane, and which achieves a mechanical advantage.

35 Claims, 10 Drawing Sheets 13
13A

LIGHT WEIGHT, FAST STEERING RIDING TROWEL

BACKGROUND OF THE INVENTION

1. Field of the Invention

The present invention relates generally to riding-type concrete finishing machines. More particularly, the present invention relates to riding-type concrete finishing trowels comprising a pair of rotatable blade-equipped rotors including control means for independently tilting the levers to effectuate enhanced steering. Representative self propelled riding trowels are classified in U.S. Class 404, Subclass 112.

2. Description of the Prior Art

As will be recognized by those skilled in the art, it has long been well known that wet concrete must be appropriately finished. A wide variety of manually pushed troweling machines have previously been proposed. However, self propelled riding trowels finish the concrete quicker and more efficiently. Riding trowels enable a user to be seated upon the trowel frame, and the revolving rotors beneath the frame directly contact the surface of the concrete.

Machines of this general nature include some form of frame from which two or more rotating blades downwardly project. The blades are propelled by a self contained motor mounted on the frame, which may be linked to rotor gear boxes. The blades are controlled by gear mechanisms having a rotatable axis generally perpendicular to the frame, and a yoke controlled bearing assembly is often employed to vary rotor pitch. The weight of the trowel and the operator is transmitted frictionally to the concrete by the revolving blades. Steering is accomplished by tilting the blade rotor assemblies to generate differential vector forces which propel the frame.

Two of the most relevant prior art riding trowels known to us are seen in U.S. Pat. Nos. 3,936,212, Issued Feb. 3, 1976 and 4,046,484, Issued Sep. 6, 1977. Both of the latter machines employ a frame having a seat for the operator which mounts two or more bladed rotors which project vertically downwardly underneath the frame carriage. Blades twistably associated with each rotor directly contact the concrete surface. Tilting forces on the rotors effectuate steering of the machine in various directions. The blades are rotated relative to the rotors (i.e. twisted) to effectuate different finishing characteristics by changing blade pitch. Both of the latter patents disclose lever means projecting vertically upward from the frame which may be manipulated by the driver to effectuate blade control. In U.S. Pat. No. 3,936,212, three individual rotor assemblies are shown, and none of the blades interlap with one another. In U.S. Pat. No. 4,046,484, the trowels intermesh to work overlapping circles, providing a gapless characteristic to obtain maximum width of surface coverage. More importantly, U.S. Pat. No. 4,046,484 teaches that rotor tilting forces needed for steering control may be applied to one of the rotors in two planes, whereas only a single plane of tilting is required for the other rotor.

A basic version of a twin rotor riding machine for surface finishing of concrete is seen in U.S. Pat. No. 2,898,826, Issued Aug. 11, 1959. U.S. Pat. No. 4,859,114, Issued Aug. 22, 1989 discloses a system for providing steering in a twin rotor concrete trowel by varying the position of frame sections to effectuate relative tilting movements of various frame portions. U.S. Pat. No. 4,784,519, Issued Nov. 15, 1988, discloses a linkage system for varying the pitch of the blade systems in unison, and an interlink system for tilting each blade to effectuate directional control. Other related riding trowels are seen in U.S. Pat. Nos. 4,775,306; 2,869,442; and 4,710,055.

However, as will be recognized by those skilled in the art, steering of all known riding trowels is cumbersome and difficult. Steering responses lag the lever inputs necessary to transmit and generate steering control instructions. It is often difficult for the contractor or owner of the machine to train an operator to properly use riding trowels in a short period of time. Even where the operator is relatively familiar with riding trowels, current steering systems are very challenging, and the steering response of known machines invites errors, collisions and accidents. Moreover, because of the typical blade and rotor assembly linkage construction employed in the prior art, impacting vibrations experienced on one rotor deleteriously affect movements of the other. The latter "bump-steering" problem compounds conventional riding trowel control deficiencies. When operating finishing machines with conventional blade-controlling linkages in tightly confined areas where various obstacles exist, operation of conventional machines is slow and clumsy.

Prior art machines are also difficult to set up. Usually blade pitch control is difficult to set, and it has been difficult in the past for operators to measure pitch. Another problem is that it is sometimes difficult for an operator to clearly see those areas of the concrete surface which may need finishing the most. No known machines provide a means for sensing irregular surface areas.

Hence it is important to provide a self propelled motorized riding trowel which is capable of succinct and delicate maneuvers and which is relatively easily controlled by the operator. It is also important to provide a highly maneuverable self propelled riding trowel of the character described which can be mastered by a operator in a short period of time, and which steers in a responsive, predictable manner.

SUMMARY OF THE INVENTION

We have developed a highly maneuverable, fast steering riding trowel which demonstrates significantly enhanced steering characteristics.

A rigid metallic frame offset from the concrete surface to be finished is supported by a pair of downwardly projecting rotors, each of which controls revolvable blades frictionally contacting the concrete surface. The frame comprises an upper deck having a generally planar surface upon which a pair of foot pedals and an operator seat are mounted. The pedals are each associated with an elevated cabinet mounted upon the frame deck. The frame mounts a battery, a fuel tank, and a conventional internal combustion motor for powering the trowel. A plurality of lights attached at each corner of the frame illuminate the concrete surface being worked when lighting is required.

When an operator is comfortably seated, he can easily manipulate a pair of vertically upwardly extending primary steering control levers with his hands. These levers are linked to the rotors through unique linkages, including a pair of elongated, parallel lever arms disposed beneath the frame, which effectuate trowel steering. The parallel lever arms extend beneath the frame from a connection to linkages at the front to a pivot connection at the rear.

By concurrently tilting each rotor, differential forces are generated by the revolving blades against the concrete surface, and vector moments resolve into steering forces. One rotor assembly preferably tilts four ways, and the other tilts only two ways. Hand movements transmitted by the operator to the steering control levers substantially correspond to the resultant direction of trowel travel. Because of our unique linkage system, hand movements necessary for particular trowel maneuvers are largely intuitive. In other words, the trowel moves in substantially the same direction as the operator's hands when he moves the primary control levers.

Each rotor assembly comprises a rotatable blade assembly depending downwardly beneath the frame into contact with the concrete surface. Besides rotating about the rotor, the trowel blades are twisted through a limited rotation about their longitudinal axis to vary pitch. The pitch of each rotor blade is controlled by assemblies including convenient handle ends which can be manually rotated by the operator to vary the pitch. In an alternative embodiment an electrical pitch control system is employed. Both the manual and electrical pitch control systems provide gauge means visible to the operator for displaying selected pitch. In either case a cable-driven clutch fork system may be employed to vary the pitch of the rotor blades relative to the plane of the surface being treated.

Each of the tiltable rotor assemblies are shaft driven by suitable gear boxes. The shafts from the gear boxes define a biaxial plane perpendicular to the machine frame deck, and steering of the apparatus is effectuated by pivoting the shafts (and the gear boxes) relative to the biaxial plane. Each gear box is movably mounted to the underside of the frame by a similar pivot steering box. The gear boxes are interconnected to the various steering linkages, and when they are deflected, the revolving blades are tilted to effectuate steering.

The gear boxes are preferably driven by a flexible drive shaft assembly including friction disk assemblies disposed between rigid coupling shafts. The drive shaft assemblies flexibly couple the motor to the gearboxes, and the entire drive train may thus flex freely as the rotors encounter stresses and vibration from uneven and rough surfaces.

A pair of lever arms beneath the frame contribute to the enhanced steering of our trowel. They are generally parallel, and they extend from captivating terminal mandrels beneath the frame rear to the front of the trowel where they terminate in suitable linkages interconnected with the primary control levers. Each lever arm is thus deflected slightly by movement of the primary control levers. Both lever arms are coupled to rigid torque rods which extend to opposite gear boxes. When the lever arms are deflected during steering, a mechanical advantage is developed, and the torque rods will tilt the gearboxes in a direction parallel with the biaxial plane. The torque arms are offset from one axis of rotation defined within the pivot steering boxes.

Additional linkages tilt one of the rotors in a plane perpendicular to the biaxial plane. Tertiary linkage means are provided in conjunction with the last mentioned linkages for generating a leveraged mechanical advantage, and for compensating for centerline changes during bending moments. Additionally, means are provided for reading the plane of the surface being worked from the operator's seat.

Thus a fundamental object of the present invention is to provide a Fast Steering Riding Trowel capable of being easily handled and maneuvered by the operator.

Another object of the present invention is to provide a riding trowel with a crisp and responsive steering system.

A basic object is to provide an ergonomic steering system for a riding trowel which easily steers the apparatus in response to intuitive and quickly learned hand movements.

Another object is to provide a self propelled motorized riding trowel which is capable of succinct and delicate maneuvers and which is relatively easily controlled by the operator.

A similar object is to provide a riding trowel which measures and displays surface irregularities.

Yet another object is to provide a highly maneuverable self propelled riding trowel of the character described which can be mastered by a workman in a short period of time, and which thereafter may be efficiently employed to finish concrete in a minimum amount of time.

Another object is to provide a riding trowel of the character described with enhanced frame stability.

A further object is to provide a riding trowel of the character described with a gauge system enabling the operator to determine the plane of the concrete surface being finished.

A related object is to enable a riding trowel of the character described to be tied down to a level gate surface for facilitating easier working of the concrete surface.

Another object of the present invention is to provide a trowel of the character described characterized by a reduced center of gravity.

Another object is to provide an automatic finishing blade pitch control system for riding trowels.

A related object is to provide a pitch control system capable of compensating for wear and tear from blade usage, which concurrently displays selected pitch to the operator.

Another object is to provide a resilient rotor control drive link system which adapts the riding trowel for rough and uneven surfaces.

Another object is to enable the riding trowel operator to expend minimal energy when manipulating and steering the machine. A feature of our invention is that the lever arms are torqued slightly to provide quicker steering lever spring back.

Another object is to simplify riding trowel drive belt adjustments and maintenance.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
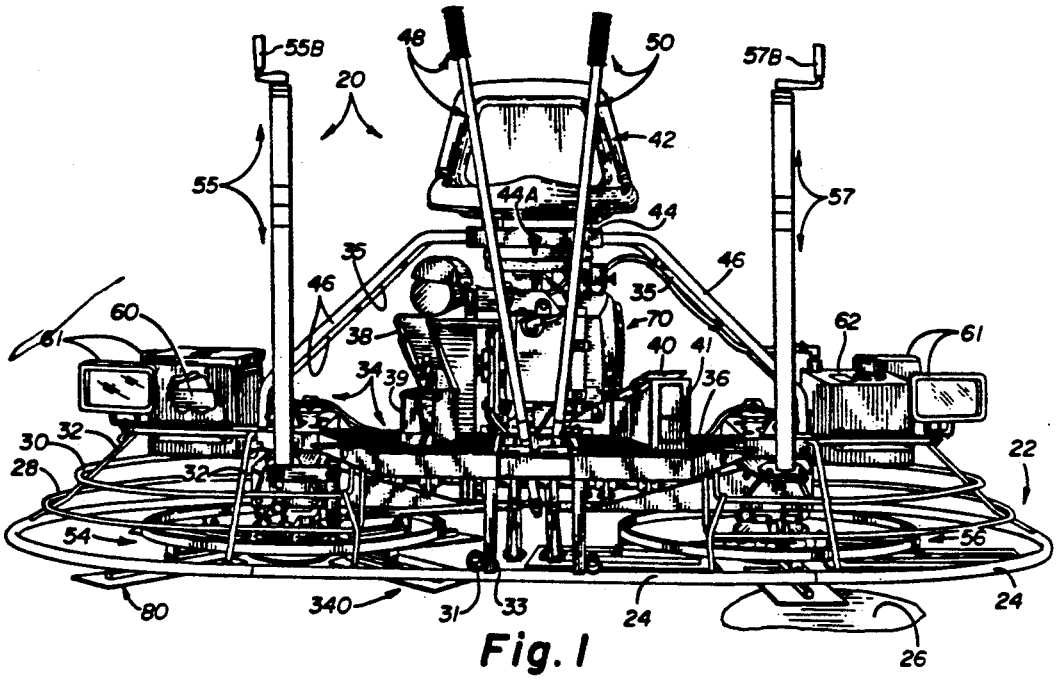
FIG. 1 is a front perspective view of our Fast Steering Riding Trowel.
Figure 2:
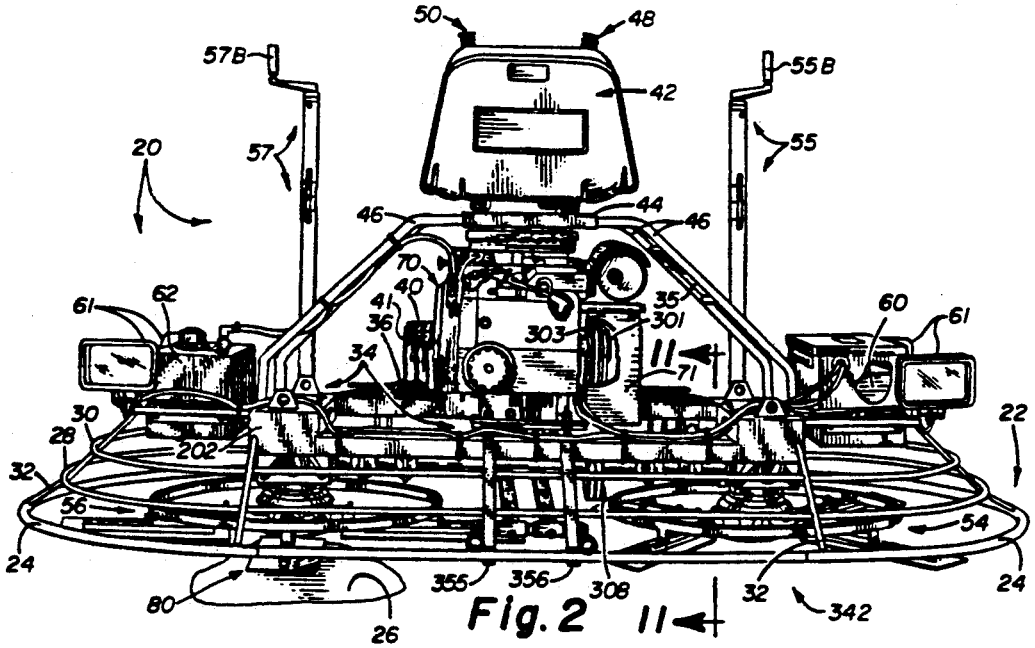
FIG. 2 is a rear perspective view thereof.
Figure 3:
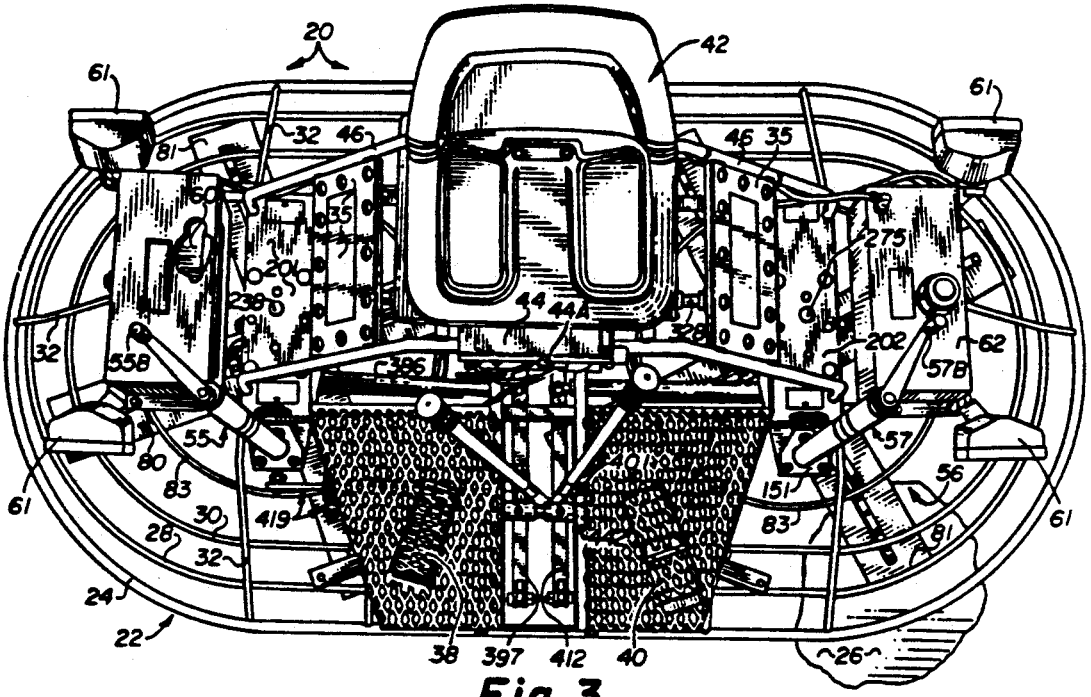
FIG. 3 is a top perspective view thereof.
Figure 4:
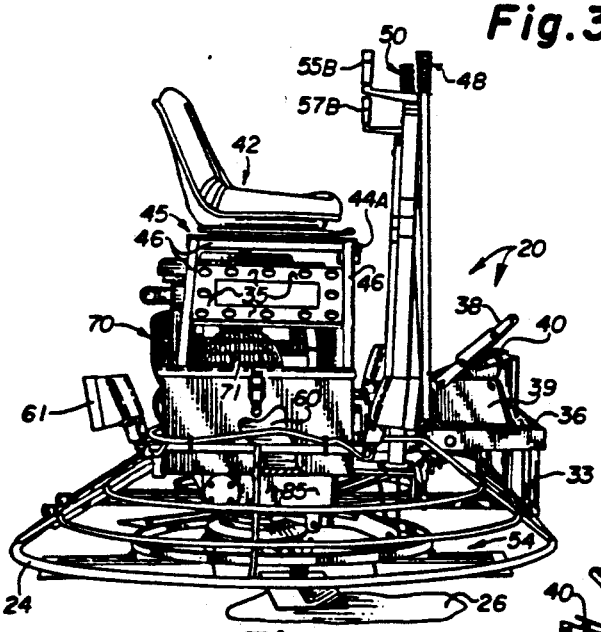
FIG. 4 is a side elevational view thereof, taken from a position generally to the left of FIG. 3.
Figure 5:
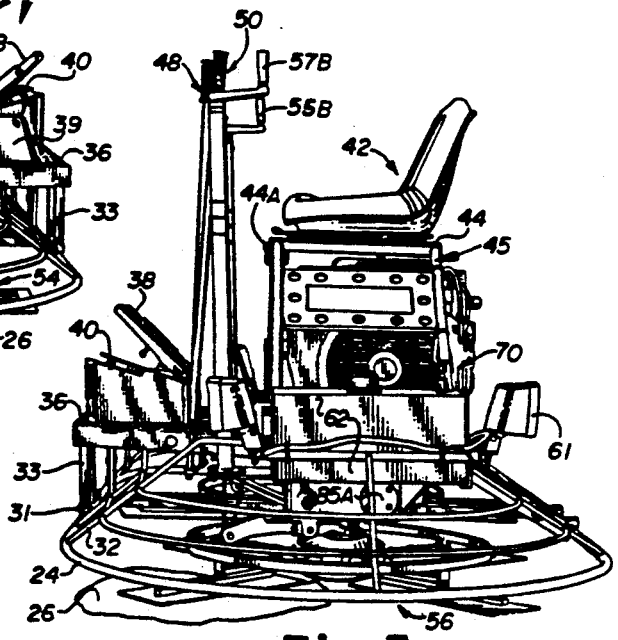
FIG. 5 is a side elevational view taken from a position generally to the right of FIG. 3.

With initial reference now directed to FIGS. 1-6 of the appended drawings, a fast steering riding trowel constructed in accordance with the present invention has been generally designated by the reference numeral 20. The highly maneuverable, self propelled riding trowel 20 may be precisely steered through a responsive steering and linkage system to be explained in more detail hereinafter.

Riding trowel 20 comprises a rigid metallic frame generally indicated by the reference numeral 22 surrounded by a rigid, lower oval ring 24 which is offset from the concrete surface 26 to be finished. Ring 24 is generally coaxial with a pair of upper reinforcement rings 28 and 30 which are located above it and which are of reduced circumference. A plurality of radially spaced apart reinforcement spokes 32 extend between the lower ring 24 and the upper frame deck 34. The frame comprises an upper deck 34 having a generally planar metallic grill 36 from which a pair of foot pedals 38 and 40 project upwardly. Suitable conventional cables (not shown) link the foot pedals to the motor for speed control. Frame struts 33 project downwardly from the deck and are welded to ring 24, being reinforced by lifting mandrels 31. Pedals 38 and 40 are each associated with an elevated cabinet mounted upon frame deck 34, generally designated by the reference numerals 39 and 41 respectively.

The frame mounts a battery 60 and a fuel tank 62 disposed on opposite sides of the frame deck. A conventional internal combustion motor, generally designated by the reference numeral 70, is disposed upon the frame deck 34 beneath the seat 42 for powering the trowel. A light 61 is preferably disposed at each corner of the frame 22.

A seat, generally designated by the reference numeral 42, is secured to deck 34 to a pivotal plate 44 which is fixed in turn by pin 44A through a sub-frame 45 projecting upwardly from deck 34 comprised of various struts 46. The sides of sub-frame 46 are buttressed by reinforcement plates 35 disposed upon both sides. The opposing end of plate 44 serves as the annular means for pivoting on sub-frame 45, allowing access to the air cleaner on top of the engine. In operation, an operator (not shown) normally seated within seat 42 will dispose his feet upon pedals 38 and 40 while his hands engage the primary control levers, generally designated by the reference numerals 48 and 50. It will be apparent from FIGS. 1-5 that an operator seated within seat 42 can easily manipulate levers 48 and 50 with his hands, and as will hereinafter be explained in conjunction with discussion of FIGS. 8A-8F, steering of the apparatus can be easily effectuated.

The entire frame 22 and deck 34 are disposed above the concrete surface 26 to be finished by a pair of rotor assemblies, generally designated by the reference numerals 54 and 56. Each rotor assembly 54 and 56 comprises a rotatable blade assembly depending downwardly beneath the frame into contact with the concrete surface 26. Each rotor assembly includes a plurality of radially spaced apart blades which physically, frictionally contact the concrete surface 26 as the rotor rotates to finish the concrete. As will hereinafter be explained, the pitch of each rotor assembly 54, 56 is preferably individually controlled by a tubular handle assembly generally designated by the reference numerals 55 and 57 respectively which includes handle ends 55B, 57B which can be rotated by the operator to vary the pitch of the trowel blades. Thus, in addition to rotating about the rotor, the trowel blades can be twisted through a limited rotation about their longitudinal axis to vary their pitch.

With reference to the aforementioned Holz U.S. Pat. No. 4,046,484, the twin rotor assemblies in a riding trowel define a biaxial plane useful for referencing component movements. The rotors each comprise a vertical axis of rotation which together occupy and define a biaxial plane. A description of how basic steering is effectuated in riding trowels of this nature is afforded in the aforementioned patent, which is hereby incorporated by reference. Basically riding trowels of this nature steer by tilting the axis of rotation of the blade rotors in directions parallel (or substantially coincident) with the biaxial plane and/or perpendicular to it. By concurrently tilting each rotor, differential forces are frictionally generated by the revolving blades against the concrete surface, and vector moments resolve into steering and propulsion forces. In the latter reference, as is the case herein, blade orientation and rotation are synchronized properly to generate the propulsion forces.

Figure 9:
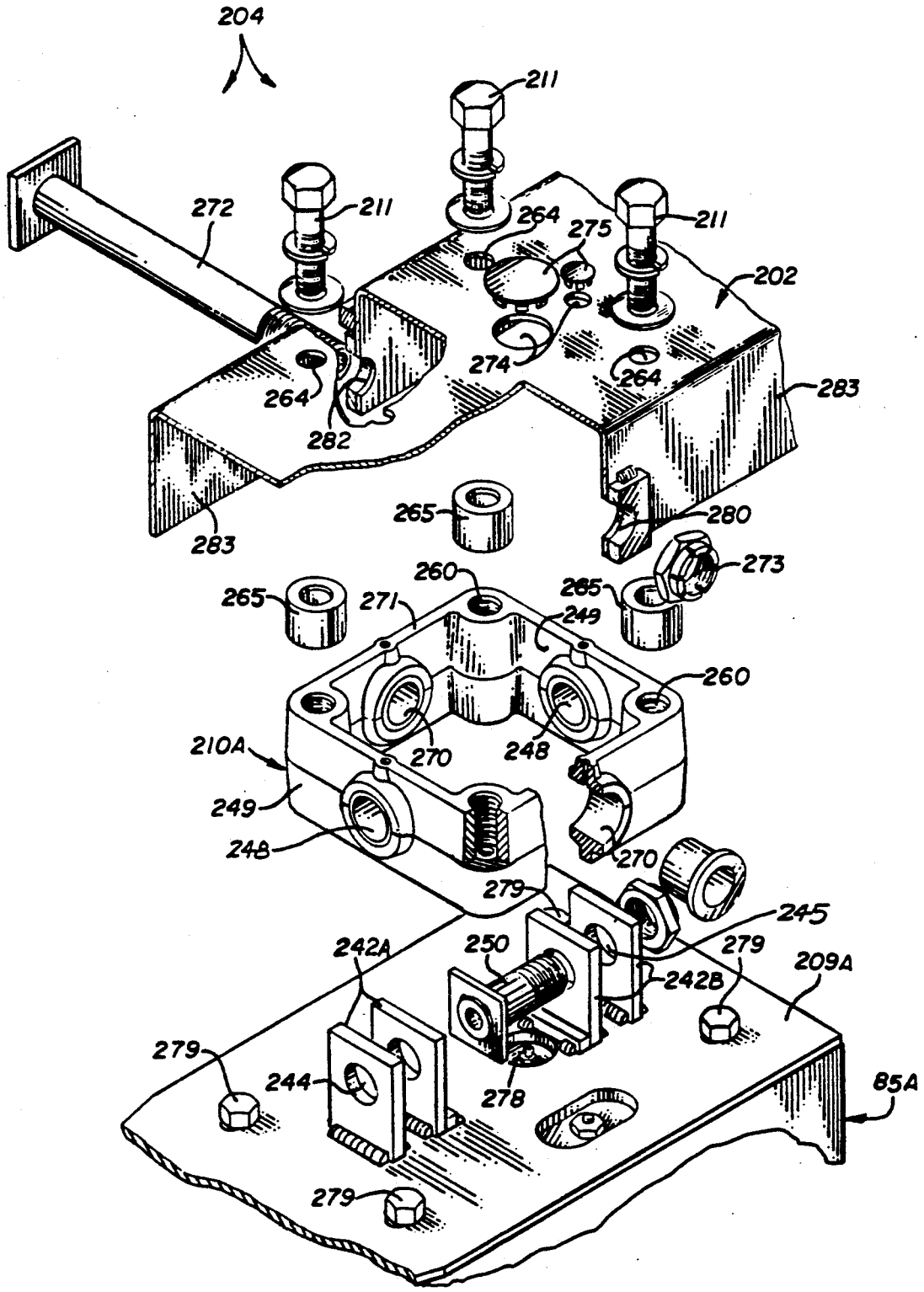
FIG. 9 is an enlarged, fragmentary, exploded isometric assembly view of the two way blade suspension control system, taken generally along line 9—9 in FIG. 6.
Figure 10:
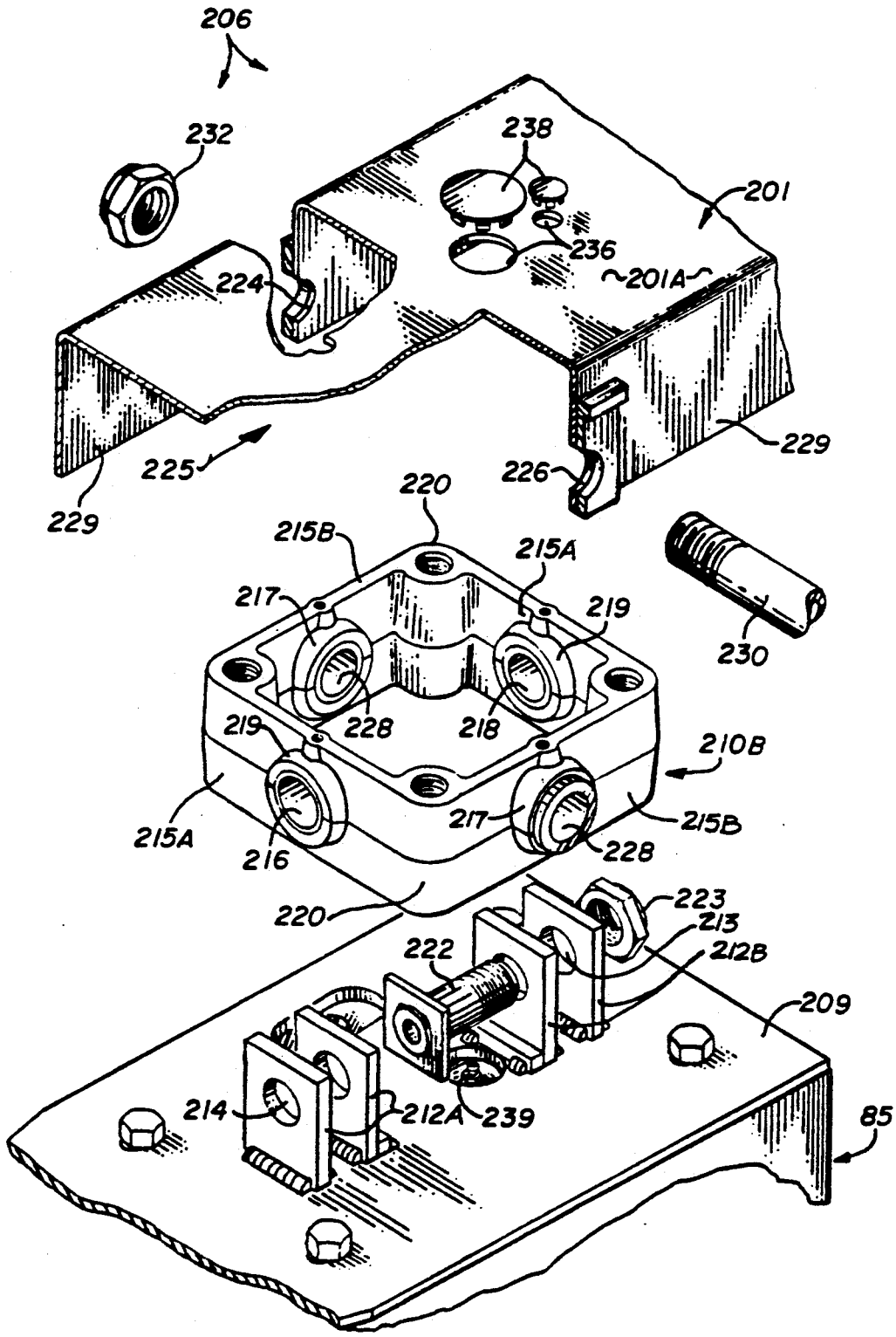
FIG. 10 is an enlarged, fragmentary, exploded isometric assembly view of the four way blade suspension control system, taken generally along line 10—10 in FIG. 6.
Figure 17:
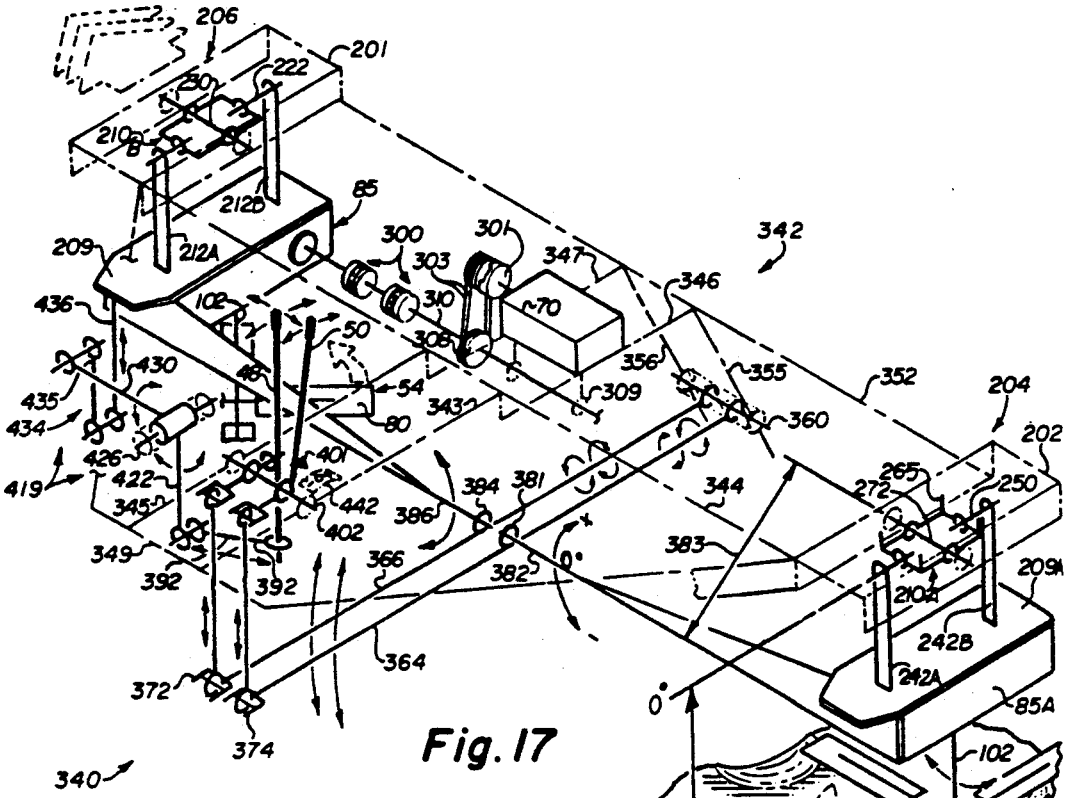
Figure 15:
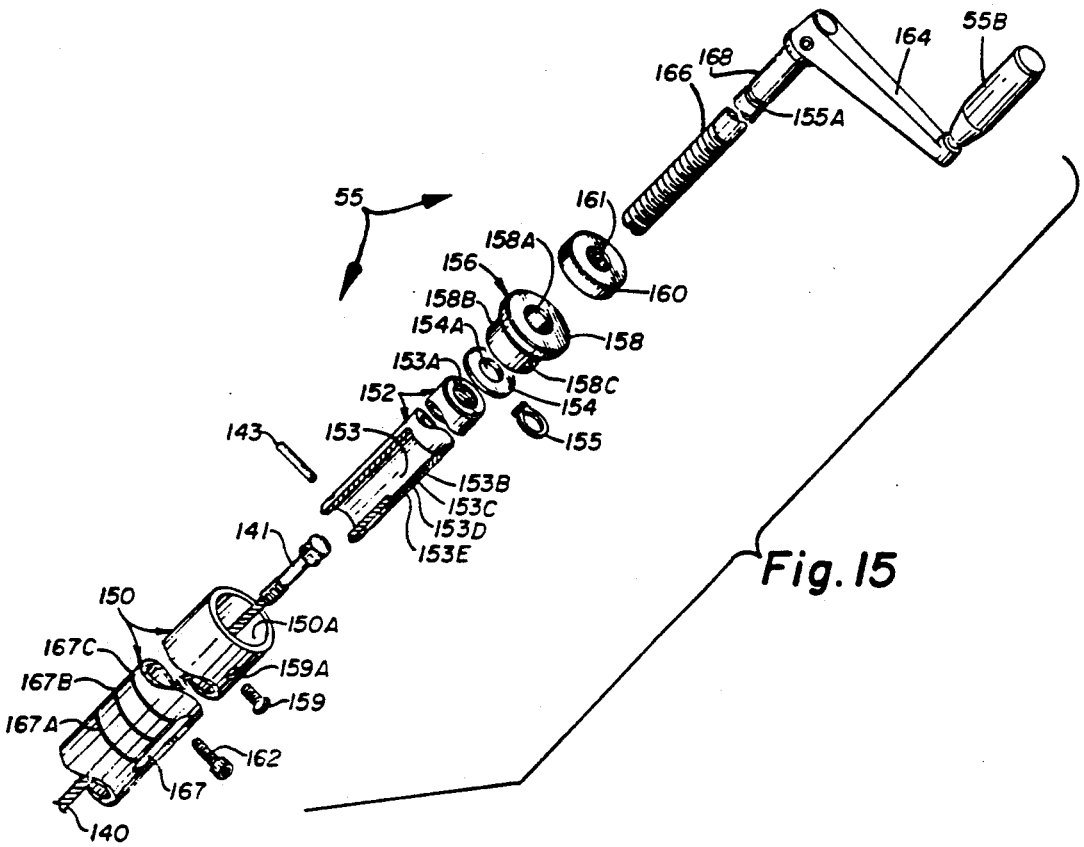
FIG. 15 is an exploded, fragmentary perspective view of the upper portion of the preferred blade pitch control system; and, FIG. 16 is an exploded, fragmentary, isometric assembly view of the preferred blade pitch control assembly; and, FIG. 17 is a combined diagrammatic and schematic view dynamically illustrating mechanical movements, with portions thereof omitted, broken away, or shown in section for clarity.
Figure 14:
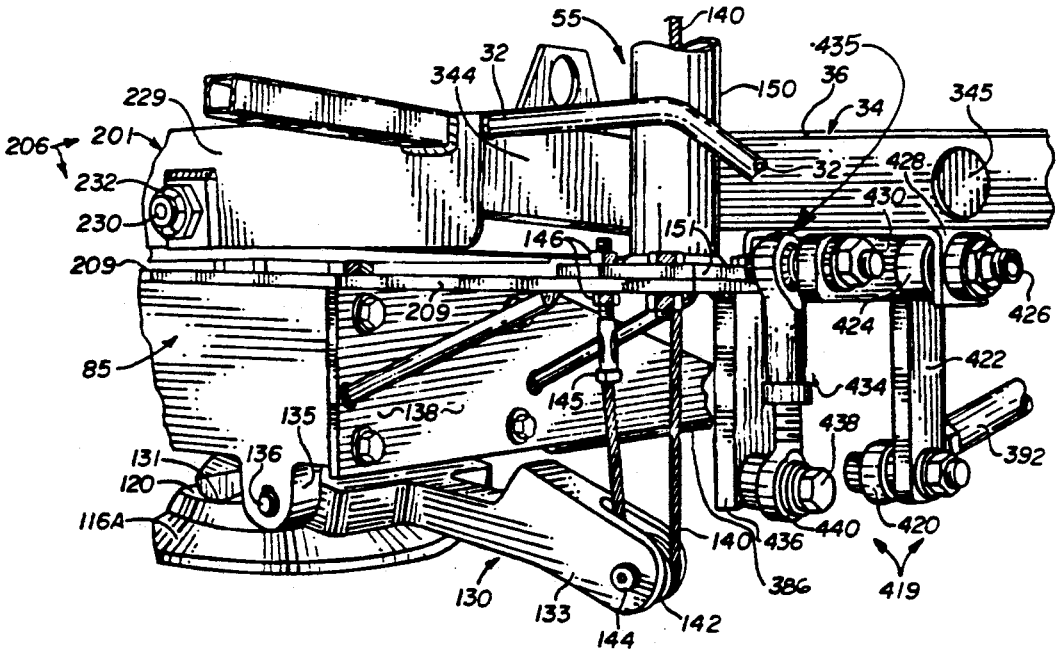
FIG. 14 is an enlarged, fragmentary, perspective view of the preferred pitch control system, and the cable attachment system, with portions thereof broken away for clarity or omitted for brevity.
Figure 16:
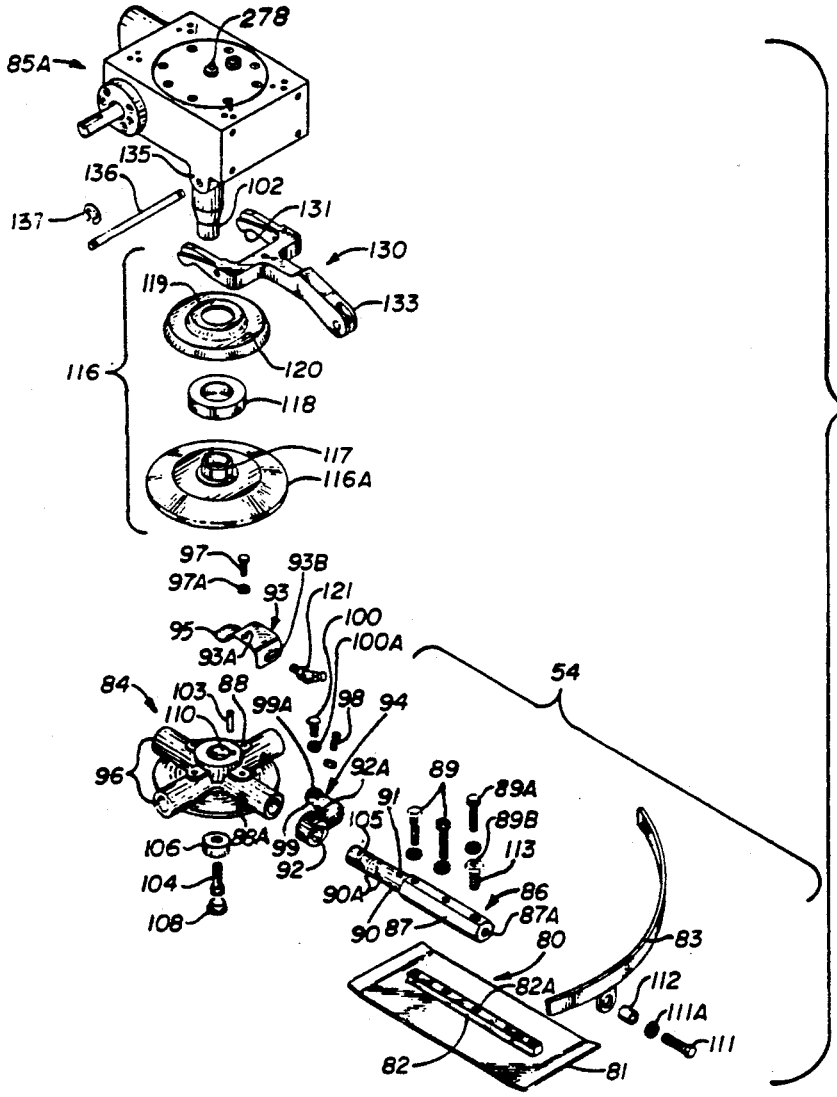

With additional reference now directed to FIGS. 14 through 16, the rotor assemblies 54, 56 tilt differently but are of substantially similar construction. Rotor assembly 54 preferably tilts four ways to the left and right and forwards and backwards. Its gear box movement thus defines planes perpendicular to the biaxial plane and parallel with the biaxial plane. However, rotor assembly 56 only tilts two ways, to the left or the right, defining a plane parallel with the biaxial plane. How a rotor may tilt is established by connection of its pivot steering box to be described later (FIGS. 9, 10). As viewed by the seated operator, rotor 56 revolves in a clockwise direction; rotor 54 revolves counterclockwise (FIGS. 17).

A typical rotor assembly 54 (FIG. 16) comprises a plurality of radially spaced apart finishing blades 80 of generally rectangular configuration which are rubbed against the concrete surface to be finished.

The blades are preferably rotated at 135 to 150 R.P.M. Terminal blade ends 81 are beveled upwardly. Each blade 80 includes an elongated mounting bar 82 generally coincident with the blade longitudinal axis. Each blade 80 is linked to a central four blade spider 84 by a connecting arm 86 whose free end 87 is fastened to bar 82 by conventional screws 89. Spider 84 is rotatably coupled to a suspension gear box, generally designated by the reference numeral 85A, to be discussed hereinafter in more detail. The gear boxes are driven by the motor to rotate the blades. The control end 90 of arm 86 penetrates the hollow end 92 of a lever control 94 and is received within one of the four radially spaced apart reception tubes 96 of spider 84. The threaded hole 92A of lever control 94 registers with detent 91 formed in end 90 of connecting arm 86, and is secured by a set screw 98. Lever control 94 comprises an offset end 99 which contains a threaded hole 99A for receiving bearing plate adjustment screw 100, which is retained by locking nut 100A.

Each connecting arm 86, with its associated lever control 94, is inserted into one of the four reception tubes 96 of spider 84. A set screw 97 with washer 97A is inserted through clearance hole 93A in the body of leaf spring 93, and with these contained, threadably engages hole 88 in reception tubes 96 of spider 84. Screw 97 further penetrates downwardly into annular slot 105 formed in the end 90 of connecting arm 86. The reception tube orifice 88A is exposed when spring 93 is installed through clearance orifice 93B. The leaf spring lip 95 underlies offset end 99 and maintains the blades in a quiescent, flat pitch. In other words, the springs 93 thereby urges the blade 80 toward a flat and parallel plane with concrete surface 26 while machine 20 is first set on a surface 26 to be treated. This prevents damage to the finishing blades from the weight of the machine when first lowered onto the concrete surface.

Figure 7A:
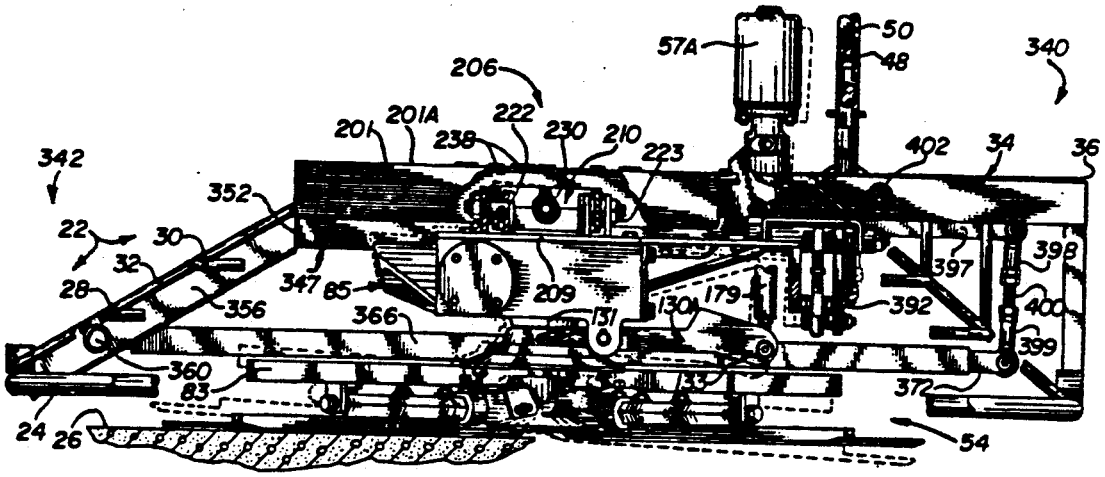
FIG. 7A is a fragmentary, right side elevational view taken generally along line 7A—7A in FIG. 6 showing the alternate pitch control system, with portions thereof broken away or shown in section for clarity.
Figure 7B:
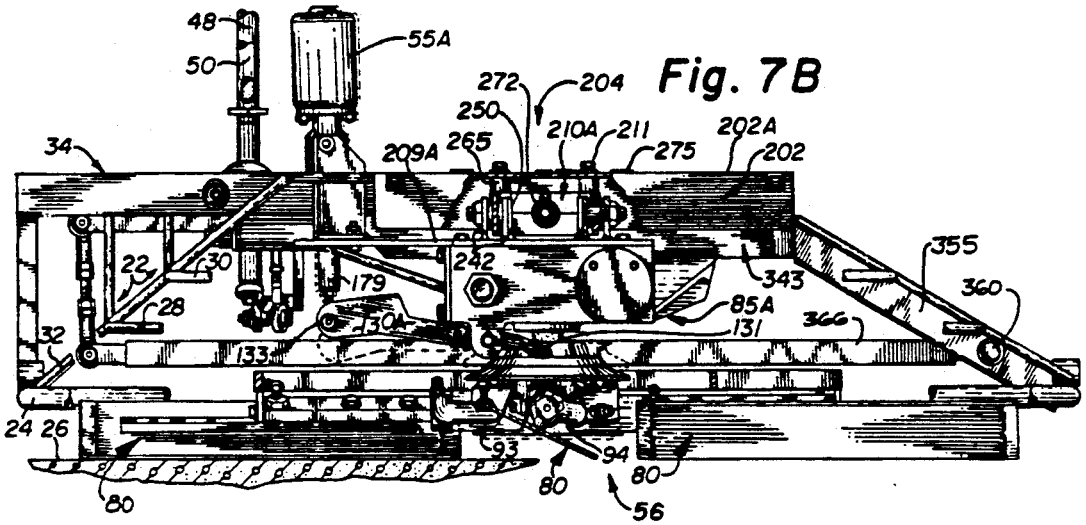
FIG. 7B is a fragmentary, left side elevational view taken generally along line 7B—7B in FIG. 6, showing the alternate pitch control, with portions thereof broken away or shown in section for clarity.

With reference now to FIG. 7B, which illustrates the rotor assembly 56 and the orientation of the blades 80 with respect to surface 26 when in full pitch. The upper portion of shaft 102 can be seen above the top of pressure plate 120. This represents a space of approximately 15/16 of an inch. This is the distance that said parts travel on shaft 102 in order to impart a maximum pitch degrees to blades 80.

A close look at FIG. 7B reveals that leaf springs 93 are being depressed by surface 99A on lever controls 94, and that it is the top of the pan head screw 100 that transfers this motion, being connected to the lever control arm 94 and to the blade assembly 56. Leaf springs 93 are installed for the purpose of biasing the blades to the Zero degree position when the machine is lifted off the concrete and the springs can be stacked one on top of the other if additional spring force is required to prevent spring set.

When the lever offset end 99 is forced downwardly when screw 100 is contacted by plate 116A, the pitch of the blade 80 is manipulated. A grease fitting 121 is inserted through clearance hole 93B and threadably engages hole 88A in reception tubes 96 of spider 84. Grease channels 90A are provided for the flow of grease to the surface of end 90 of the connecting arm 86. An outer peripheral stabilizing ring 83 of circular dimensions attaches to the outermost peripheral ends of connecting arms 86 utilizing threaded hole 87A and incorporating screw 111, washer 111A, and bushing 112. Ring 83 is concentric with the rotor, and reinforces the blade assembly. Screw 113 is used as a means of compensating for a bent or damaged connecting arm 86. It is provided with an internal threaded hole 89B to receive screw 89A. Screw 89A is also received by threaded hole 82A in bar 82.

The spider 84 is similarly connected to three other blades, and is secured to the downwardly projecting drive shaft 102 by a suitable screw 104 which penetrates thrust bearing 106 and is covered by cover 108, and axially penetrates the central orifice 110 in spider 84. Shaft 102 is keyed within spider 84 orifice 110 by key shaft 103.

Figure 6:
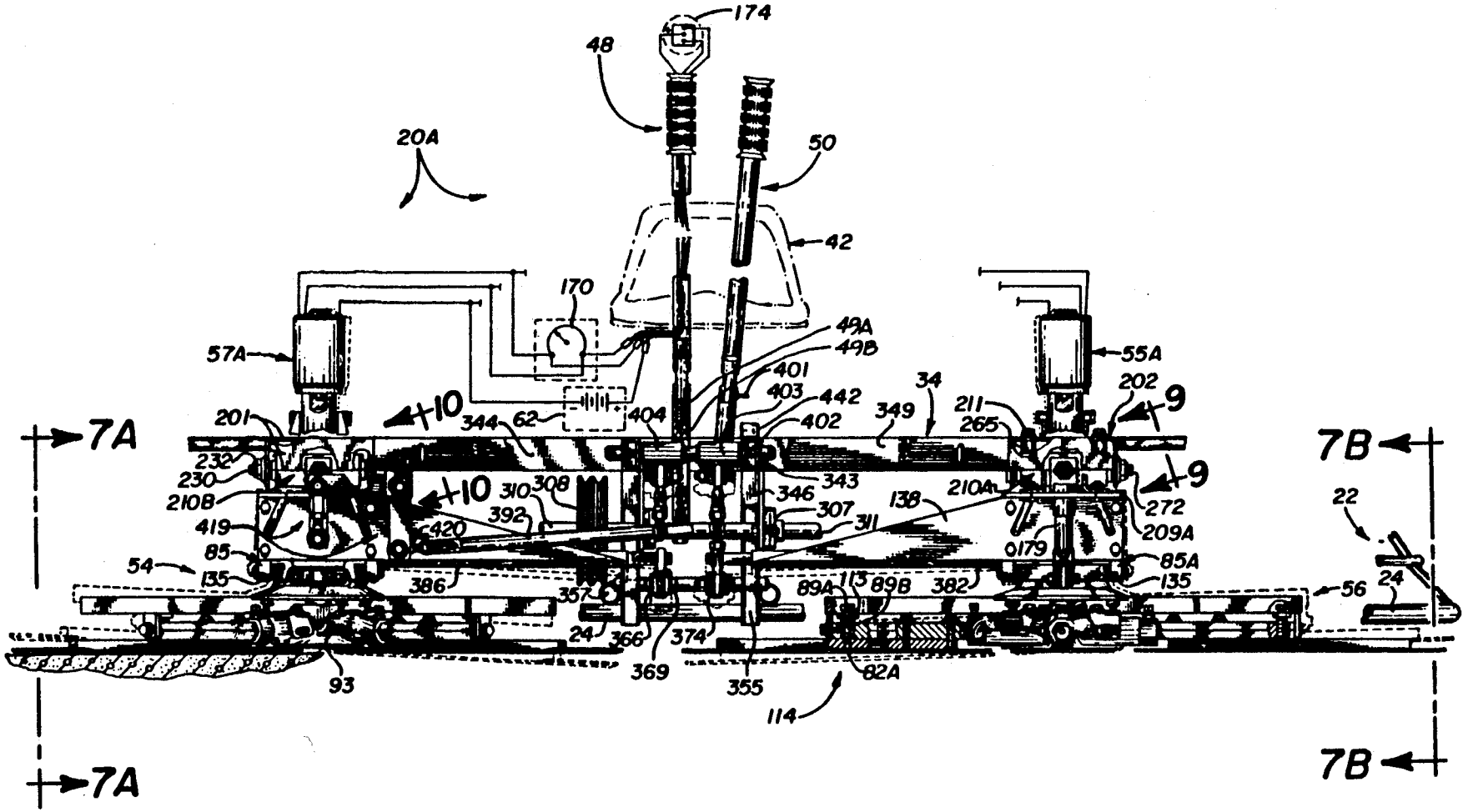
FIG. 6 is an enlarged fragmentary, elevational view showing the alternative electric pitch control system, with portions thereof omitted, broken away, or shown in section for clarity.

The clutch fork system generally designated by the reference numeral 116 (FIG. 16) is employed to vary the pitch of the rotor blades between minimum and maximum positions. In the preferred embodiment the blade pitch may be varied between approximately zero to forty degrees relative to the plane of the surface being treated. Blade pitch relative to the surface is illustrated, for example, by blade 80 in FIG. 7B, and a flatter pitch is illustrated in FIG. 6. A bearing plate 116A secured by thrust bearing 118 and cap pressure plate 120 are all penetrated by shaft 102 which is keyed into orifice 110 in spider 84. When shaft 102 rotates in response to gear box 85A, the rotor assembly will be forced to rotate, causing blades 80 to vigorously rotate against the surface of the concrete to be finished. Thrust bearing 118 is press fitted on the central, tubular shank 117 projecting upwardly from bearing plate 116A. The top of thrust bearing 118 contacts the underside of the concentric, raised cup portion 119 of pressure plate 120.

The pitch of the blades 80 are determined by limited rotation of shaft 86 relative to spider tubes 96. The basic pitch of the blades is set by levers 55 and 57 previously discussed. The desired pitch used for finishing the concrete depends upon a number of variables known to those skilled in the art such as the coldness, hardness, slump or wetness of the concrete. The flat pitch as seen in FIG. 6 (zero degrees tilt) is ideal for working soft, wet surfaces. A maximum pitch (i.e. FIG. 7B) is desirable for burnishing harder, dryer surfaces. Intermediate pitches are used for plastic concrete of middle hardnesses.

Bearing pressure is controlled by a fork generally designated by the reference numeral 130 whose prongs 131 depend downwardly upon cap pressure plate 120 in response to force upon fork arm 133. Shaft 90 of connecting arm 86 is received within the interior of spider tube 96, and locked for limited rotation. Shaft 90 is rigidly fitted against the mandrel portion 92 of lever control 94 by set screw 98 and captured within tube 96 by set screw 97, and it is rotatable in response to pressure on top of screw 100 acting in conjunction with lever control 94. When bearing plate 116A is forced downwardly against the top of screws 100, all of the blades will rotate (i.e. twist in unison) relative to spider 84. In FIG. 7B movement of the fork 130 is illustrated by dashed lines, and the slanted leading edge of the blade 80 beneath the frame reveals the blade pitch.

Figures 11, 11A, 12:
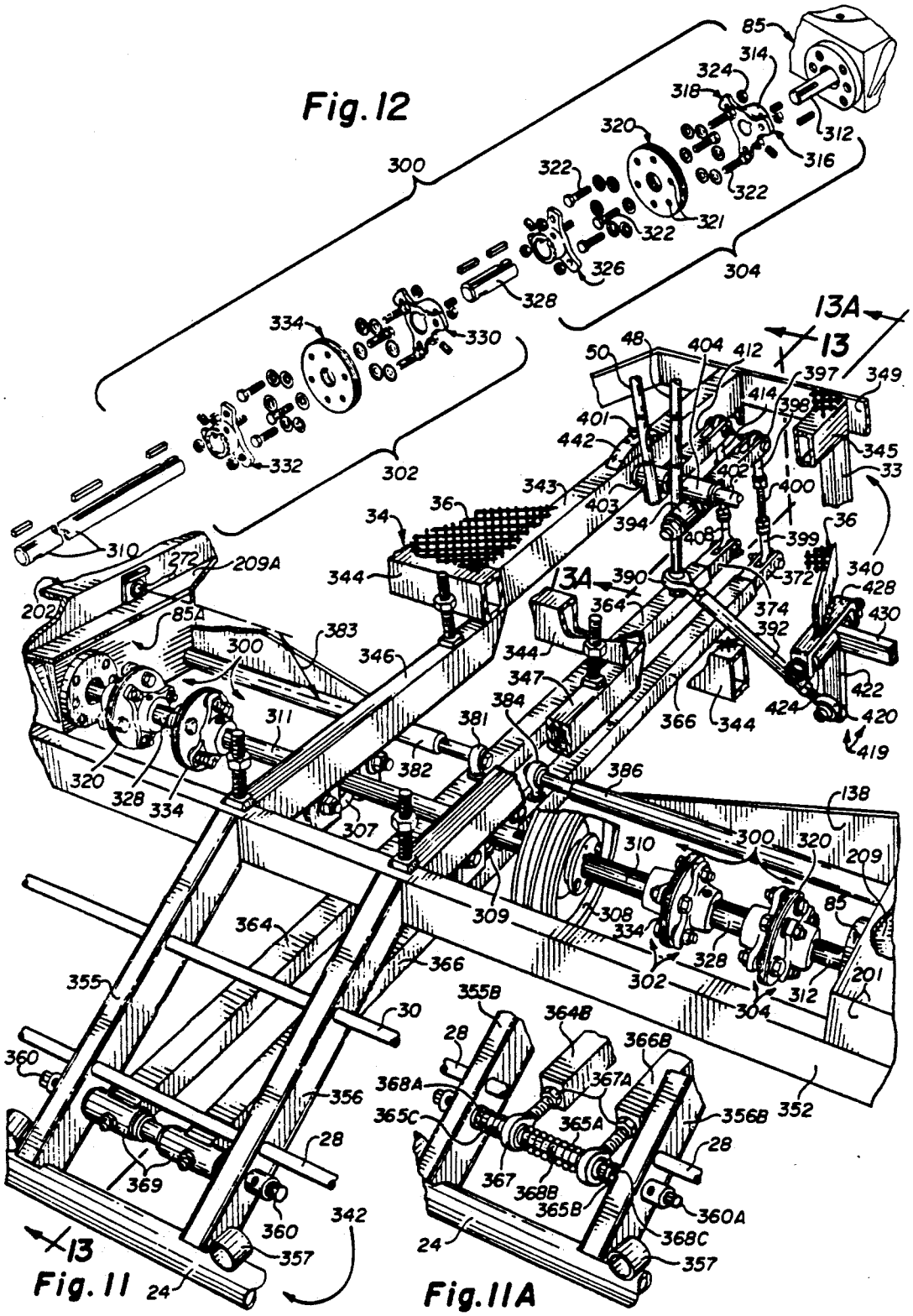
FIG. 11 is an enlarged, fragmentary, isometric view of the carriage underside, showing the preferred flexible shaft drive coupling system and the lower control steering levers, taken from a position generally along line 11—11 of FIG. 2.
FIG. 11A is a fragmentary, isometric view similar to FIG. 11, but showing an alternative termination for the lower control steering levers, with portions thereof omitted for brevity.
FIG. 12 is an exploded, fragmentary, isometric assembly view of the preferred flexible disc drive coupling system, comprising that half of the drive coupling system seen generally in the right half of FIG. 11.

Turning now to FIGS. 14 and 15, fork 130 is pivotally secured between a pair of rigid, downwardly extending tabs 135 on gear box 85 by a suitable axle 136 whose ends receive snap ring retainers 137. The fork prongs 131 are pivoted against plate 120 when fork arm 133 is pressured upwardly as viewed in FIG. 14. For blade pitch adjustments a pair of handles such as handle 55 may be manipulated. The handle base plate 151 is secured to frame plate 209 which overlies the generally triangular, outer gearbox side gusset 138 (FIGS. 6, 11, and 14). It is equipped with a steel cable 140 that terminates in plate 209 and base plate 151 via threaded, crimped end 145 and lock nuts 146. Cable 140 in entrained over a suitable pulley 142 captured for rotation over screw 144 penetrating fork arm 133. A mechanical advantage is thus obtained. The cable is anchored at plate 209 and base plate 151 and extends upwardly through plate 205 into the handle tube 150. Cable 140 terminates in a crimped fitting 141 received within the interior 153 of bushing 152 and locked by a pin 143.

Tubular housing 150 is welded at its bottom to the base plate 151, and extends vertically upwardly from the frame deck for convenient access by the operator. The interior 150A of tube 150 receives a tubular, slidable bushing 152 (FIG. 15). Bushing 152 is retained via a washer 154, a snap ring 155 and a bushing 156 having an enlarged cap 158 and a bearing 160. The control handle 55B including lever portion 164 rotates a threaded shaft 166 received through the orifice 161 in bearing 160, orifice 158A in bushing 156, orifice 154A in washer 154, and threaded orifice 153A in the top end of bushing 152. Snap ring 155 is positioned in groove 155A defined in the non-threaded portion 168 of shaft 166. The assembly is retained by pin 143 which penetrates threaded hole 158C in bushing surface portion 158B.

Final assembly and adjustment of handle assembly 55B is accomplished by the positioning of cable end 145 in plate 209 (FIG. 14) and the manipulation of handle 55B to tension cable 140 so that slidable bushing 152 assumes an appropriate position within tubular housing 150. One full revolution of shaft 166 can be made before cable 140 acts on fork arm 133. At this time tubular housing 150 will be exposed through slotted orifice 167, and the threaded holes 153B, 153C, 153D or 153E can be seen (FIG. 15). When this adjustment is made, screw 162 is inserted to thereby maintain the correct cable tension on cable 140 and the travel range of the fork 130.

Thereafter the indicator rings 167A, 167B and 167C marked on tube 150 may visibly register with screw 162 to provide a visual blade pitch indication to the operator. Screw 162 thus provides an index mark for determining pitch from the indicator rings. Ring 167A indicates that the blades are flat (i.e. zero degree pitch), ring 167B indicates half pitch, and ring 167C indicates full pitch. When so adjusted, handle 55B may be rotated in a clockwise direction thereby tensioning cable 140, which in turn draws fork lever 130 upwardly, so that the prong elements 131 apply a downward pressure on plate 120 causing the blade elements to twist as described, therefore changing the blade pitch. By routing the pitch control cable 140 through pulley 142 and up into plate 200 and 151, a 2:1 mechanical advantage is obtained. Since corresponding travel is doubled, slot 167 in tubular housing 150 is longer, thereby allowing for a greater number of pitch increments to be used.

With reference now directed concurrently to FIGS. 6, 7A, 7B, an alternative pitch control system is shown on the alternative trowel 20A. Trowel 20A is largely similar to trowel 20 previously described, at least beneath the frame. However, it replaces the hand operated blade pitch controls 55, 57 with electric, linear actuators 55A, 57A. Each actuator may be electrically controlled, as drawn diagrammatically in FIG. 6, via a rheostat 170 which interconnects the linear actuators to the battery 62 on the bow. A push button switch 174 disposed at the top of primary control lever 48 controls the linear actuators, which may be electrically wired in parallel. When the linear actuators are operated, a downwardly projecting plunger 179 will actuate the fork lever 130A (FIG. 7B), prong elements 131 will be pivoted downwardly into contact with pressure plate 120, causing the blade elements to twist as described, therefore changing the pitch.

Turning now to FIGS. 9 and 10, the tiltable rotor assemblies are driven by gear boxes 85 and 85A, via a downwardly projecting shaft 102 (FIG. 16). Shaft 102 rotates to turn the blades and finish the concrete. The shafts from each of the gear boxes, however, define a biaxial plane perpendicular to the machine frame deck, and steering of the apparatus is effectuated by pivoting the shafts 102 relative to this plane. Each gear box is movably mounted to the underside of a frame channel portion 201 or 202 (FIGS. 2, 9, 10) or by a tiltable, pivot steering box 210A or 210B. The gear box 85A, for example, seen at the top of FIG. 16 is partially illustrated at the bottom of FIG. 9; it is tiltably coupled to the underside of the frame (i.e. frame portion 202 at the top of FIG. 9) for movement as described hereinafter.

The suspension system 204 seen in FIG. 9 is a two way system, which is different from four-way system 206 in FIG. 10. Gear box 85 in system 206 may be pivoted in a plane perpendicular to the biaxial plane and another plane parallel with the biaxial plane. System 204, on the other hand, can pivot gear box 85A only in a plane parallel with the biaxial plane. While the pivot steering boxes 210A or 210B used in each system are structurally identical, they are mounted differently for steering purposes.

The top plate 209 of gear box 85 (FIG. 10) is linked to the frame channel member 201 by pivot steering box 210B. Plate 209 includes twin pairs of upwardly rising nubs 212A and 212B having aligned orifices 214 and 213 adapted to register with bearing orifice 216 on side 215A of the pivot steering box 210B during assembly. Each reinforced bearing 219 will fit between tabs 212A or 212B. Pivot steering box 210B is generally square, including four tapped and reinforced corners 220. Suitable bearing mandrels 217 are formed in sides 215B, and mandrels 219 are formed in sides 215A. Suitable bearing bolts such as bolt 222 may be fitted through the tabs 212A, 212B and orifices 216, 218 as shown to suspend pivot steering box 210B for relative pivotal movements. Each bolt 222 is retained by friction nut 223. Pivoting about bolt 222 results in gearbox movement in an arc occupying a plane parallel with the biaxial plane.

Pivot steering box 210B is received within the underside of the frame channel portion within interior 225, and positioned so that orifices 224 and 226 in downwardly depending frame edges 229 are aligned with orifices 228 in pivot steering box sides 215B. The upper surface 201A includes a pair of inspection orifices 236 which may be exposed by removing plugs 238 to permit access to the gear box grease fitting 239. Bolt 230 penetrates aligned orifices 224, 226 and 228 in assembly, and it is retained by compression nut 232. When gearbox 85 pivots about bolt 230, it moves in an arc which defines a plane perpendicular to the biaxial plane. Thus gear box 85 may pivot in two directions relative to the frame.

The pivot steering box 210A in FIG. 9 is identical with box 210B of FIG. 10, but it is attached and used differently. The top 209A of gear box 85A is similarly configured with pairs of upwardly projecting tabs 242A and 242B including orifices 244, 245 aligned during assembly with the orifices 248 in the pivot steering box sides 249. A pair of bearing bolts penetrate orifices 244 and 248 in assembly, but a single bearing bolt 250 is illustrated. Relative pivotal displacement or twisting about the axis of bearing bolt 250 is thus insured; the latter rotation is in an arc defining a plane parallel with the biaxial plane. However, rotation about the axis established by bolt 272 is not permitted; gearbox 85A cannot pivot in a plane perpendicular to the biaxial plane. Pivot steering box 210A is bolted directly to the underside of frame channel member 202. It comprises a plurality of tapped holes 260 in its corners which register with orifices 264 defined in frame channel 202. Rigid bolts 211 penetrate spacers 265 and threadably engage orifices 260.

Orifices 270 in the pivot steering box sides 271 receive a bolt 272 which penetrates orifices 280 and 282 in the opposite downwardly depending sides 283 of frame member 202, but relative rotation about bolt 272 is prevented by the rigid bolts 211 and spacers 265. Bolt 272 is restrained by compression nut 273. Orifices 274 provided in frame member 202 may be exposed by removing plugs 275 to permit access to grease fittings 278 in the gear box 85A and gear box mounting bolts 279.

With joint reference now to FIGS. 11 and 12, the gear boxes 85 and 85A are driven by a similar flexible drive shaft assembly 300. Each drive shaft assembly extends between the gear box and a dual drive pulley 308 (FIG. 11) coupled by a pair of conventional belts 303 extending to a conventional centrifugal clutch 301 (FIGS. 2, 17) coupled to the drive motor 70 within shroud 71. Each flexible drive shaft assembly 300 is substantially identical, except for the length of the jack shaft rod 310, 311 interconnected on opposite sides of the pulley assembly.

Each assembly 300 preferably includes a pair of friction disk assemblies 302, 304 (FIG. 12). As best seen in FIG. 12, an output shaft 312 emanating from the gear box 85 is keyed to the hub 314 of a first spider 316. The radially spaced apart arms 318 of each spider 316 are bolted to the flexible disk array 320 with suitable bolts 322 which penetrate orifices 321 in friction disk array 320 from the opposite side, and which are secured by nuts 324. A companion spider 326 is similarly bolted to the opposite side of friction disk array 320. The friction disk pairs 302 and 304 are interlinked by a short keyed shaft 328 which extends between spider 326 and the similar spider 330. Spider 330 and its companion spider 332 are similarly mated to the disk array 334 as previously described. Jack shaft 310 is keyed to spider 332, and it is rotatably received through first and second pillow blocks 307 and 309 associated with the frame underside (FIG. 11). Each of the drive shaft assemblies 300 flexibly couple the motor 70 to the gearboxes 85 or 85A, and the drive train may thus flex freely as the rotating blades encounter stresses and vibration from uneven and rough surfaces. Thus the drive train is able to bend in response to movement of the rotor assemblies over concrete being finished, and vibrations which would otherwise be transmitted to the frame and the operator will be attenuated. The drive shaft assembly 300 accommodates stresses in response to variation in rotor pitch, variation in rotor tilting for steering purposes, and variations encountered in normal surface treating.

Turning now to FIGS. 11 through 13 and 17, the steering system to be now described functions in cooperation with the drive shaft assemblies 300 to effectuate steering by tilting the rotors. The manually operated primary steering control levers 48 and 50 (FIGS. 1 and 3) previously described ultimately effectuate steering when hand movements similar to those seen in FIGS. 8A–8F are made. It is important to note that because of the linkage described below, hand movements transmitted by the operator to the primary control levers 48, 50 will correspond intuitively to the resultant direction of trowel travel, as seen in FIGS. 8A–8F.

Figure 13A:
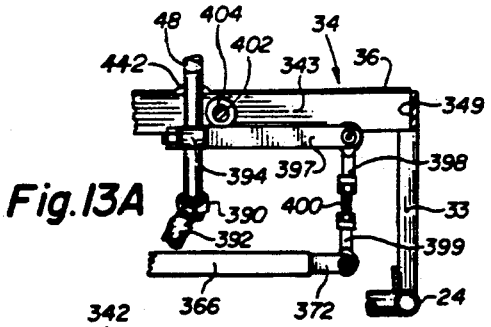
FIG. 13A is a fragmentary, side elevational view similar to FIG. 13 taken generally along line 13A—13A of FIG. 11, with portions thereof broken way, omitted for brevity or shown in section for clarity, which further illustrates a portion of the preferred steering linkage coupling system.
Figure 13:
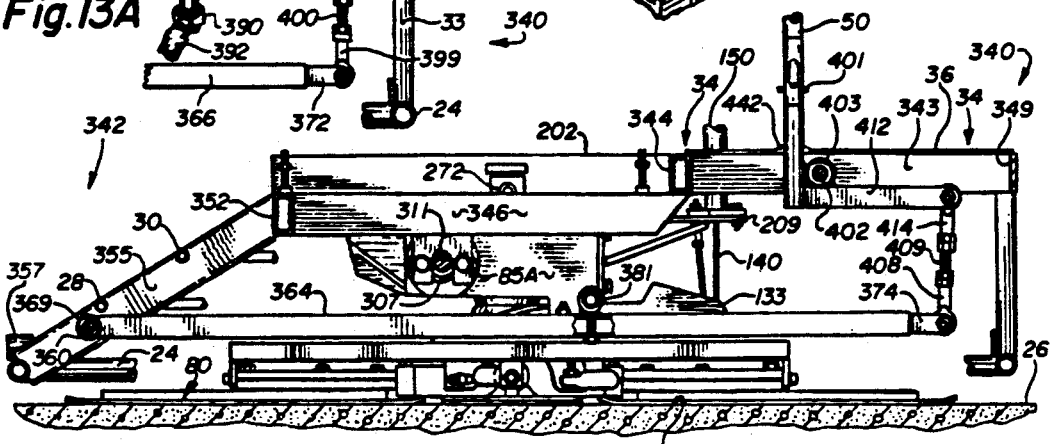
FIG. 13 is a fragmentary, exploded perspective view taken generally along line 13—13 of FIG. 11, with portions thereof broken way or omitted for brevity or shown in section for clarity, which illustrates a portion of the preferred steering linkage coupling system.

With primary attention directed to FIGS. 11, 13, and 17, the front of trowel 20 has been generally designated by the reference numeral 340; the rear has been designated by the reference numeral 342. Frame 22 comprises a cross piece 344 coupled to the front bumper 349 by a pair of rigid, spaced apart struts 343 and 345. Cross piece 344 is welded to a pair of lower rigid frame struts 346, 347 which extend rearwardly to rigid frame strut 352. Strut 352 is welded to a pair of rearwardly projecting, downwardly inclined struts 355, 356 which are parallel and spaced apart from one another. The extreme lower ends of the struts 355, 356 are welded to the oval ring 24 surrounding the frame, with reinforcement provided by lifting mandrels 357, and it will be noted from FIG. 11 that they are penetrated by the reinforcement frame rings 28 and 30. Struts 355 and 356 support a dead shaft 360 which extends between them for supporting critical lever arms 364 and 366.

Lever arms 364 and 366 are generally parallel, and they extend from terminal mandrels 369 welded to their rear ends all the way to the front 340 of the machine, where they terminate in front clevis's 372, 374. Lever arms 364 and 366, which rotate slightly relative to shaft 360, are axially oriented generally perpendicularly to the biaxial plane. Lever arm 364 supports a ball and socket joint 381 which terminates in torque rod 382 extending to the gear box 85A. A suitable ball and socket joint is available under the trade name Heim. Similarly, lever arm 366 supports joint 384 coupled to torque rod 386 rigidly extending to gear box 85.

When lever arms 364 or 366 are lifted/depressed (i.e. "rotated") and moved (as will be described later) during steering, torque rods 382 and 386 tilt the gearboxes 85A and/or 85 respectively in planes parallel with the biaxial plane to help facilitate steering. For obtaining the enhanced steering characteristic of our design, these torque rods 382, 386 are offset from the a pivot axis established by aligned bearing bolts 272, 230 (FIGS. 9, 10) as indicated generally by arrow 383 (FIG. 11). The latter axis is parallel with the biaxial plane and although only one rotor tilts perpendicular to the plane, it establishes the pivot direction perpendicular to the biaxial plane. Moreover, each torque rod is at least partially coextensive with the generally triangular gusset 138 (FIGS. 6, 11) associated with each gear box. As best noted from a comparison of FIGS. 6 and 14, the gusset 138 forms the front outermost plate of each gearbox housing. The torque rods extend along the bottom of the gusset 138 to which they are welded, and reinforcement against significant bending stresses generated by the trowel is thus achieved. Also, because of the structure depicted, bending forces are properly concentrated for gearbox tilting in a plane parallel with the biaxial plane.

With primary reference now directed to FIG. 11A, alternative lever arms 364B, 366B may terminate in ball and socket joints 367 captured by shaft 360A extending between struts 355B and 356B. Coiled knuckle springs 365C, 365A, and 385B captivated upon shaft 360A (about shaft spacers 368A, 368B, and 368C respectively) are tightly fitted between joints 367. The effective length of the control arms may be varied during setup by loosening locknuts 367A. This construction maintains a set distance between lever arms 364B and 366B during stress. When the torque rods are moved up or down and cause lever arms 364B and 366B to twist this will in turn cause the joints to incline and torsionally compress the knuckle springs providing a quick return to rotor assemblies 54 and 56 and primary control levers 48 and 50. In operation the springs react to both torsional forces, and to compression/extension forces to center the lever arms and urge them into a quiescent position. The ball and socket joints 367 are threadably inserted into the ends of lever arm 364 and 366 adjustably secured in place by lock nuts 367A. This axially variable frontward or rearward adjustment allows one to easily mate ball and socket joints 381 and 284 with their respective torque rods 382 and 386 during assembly.

Both primary steering control levers 48 and 50 extend through the trowel frame deck 34 to the underside of the frame, for interconnection with the lever arms 366, 364 respectively. As appreciated from FIG. 6, each lever 48 is removable; lever 48, for example, includes a lower threaded stub 49A threadably mated to the lower extension 49B of the lever. Lever 48 can be pushed or pulled, and moved to the operator's left and right, whereas lever 50 need merely be pushed or pulled for steering. Lever 48 terminates beneath the frame in a ball and socket joint 390 at the end of a connection shaft 392 (FIG. 13A). Connection shaft 392 ultimately transmits a bending moment to gearbox 85 to cause it to tilt in a plane perpendicular with the biaxial plane for steering purposes. A cross shaft 402 (FIGS. 11, 13) journaled between struts 343 and 345 supports mandrels 403 and 404 which it penetrates. Lever 48 is also coupled to a mandrel 394 rotatably captivated at the end of a clevis link 397, which is in turn coupled to ball and socket joint 398 linked by a threaded shaft 400 to ball and socket joint 399. Joint 399 projects from clevis 372 at the front end of the lever arm 366 previously described. Mandrel 404 is welded to link 397; mandrel 394 is welded to rod 48. Therefore when lever 48 is moved toward or away from the front of the trowel (FIGS. 8A, 8B) in unison with lever 50, the trowel moves forward or rearward, gearbox 85 is thus pivoted by lever 48 in the direction enabled by bolts 222 in steering box 210B (FIGS. 10 and 17).

When primary control lever 48 is moved forward or backwards (i.e. defining a plane perpendicular to the biaxial plane established by gear box drive shafts 102) the trowel steers forward and backward as illustrated generally in FIGS. 8A through 8D. When so pivoted mandrel 404 (FIGS. 11, 13A) is rotated slightly, and link 397 ultimately deflects lever arm 366 to tilt gearbox 85 in a plane parallel with the biaxial plane. When primary control lever 48 is moved to the operator's left or right, connection shaft 392 moves generally to the right or left as lever 48 rotates mandrel 394, and causes the gearbox 85 to tilt, defining a plane perpendicular to the biaxial plane.

Connection shaft 392 tilts gearbox 85 in an arc defining a plane perpendicular to the biaxial plane. Shaft 392 leads from the bottom of primary control lever 48 to a tertiary linkage generally designated by the reference numeral 419. The purpose of tertiary linkage 419 is to derive a mechanical advantage when tilting gearbox 85 perpendicularly to the biaxial plane, and to compensate for changes in centerline distance between components when the gearbox is tilted, especially when tilted in a plane parallel with the biaxial plane (i.e. when lever 48 is pushed or pulled). The instant construction eases the operator-applied force required upon primary lever 48. Shaft 392 is terminated in joint 420 (FIGS. 11, 14) which attaches it to a somewhat C-shaped crank means 434. Shaft 392 is captured by a vertical link 422 (FIG. 14) welded at its top to mandrel 424. Mandrel 424 is journaled to and captivated by axle 426 secured within a rigid support brace 428 welded beneath the frame. Link 430 projects horizontally away from mandrel 424, and is rotated by same; it deflects coupling 435 fastened to rigid lug 436 by bolt 438 which penetrates terminal joint 440. Thus when connection shaft 392 is axially deflected, a mechanical advantage is derived from and transmitted through crank means 434 (i.e. links 422, 430, and 435) and applied to the gearbox 85 by lug 436 (FIG. 14). At the same time, link 397 moves axially toward and away from the frame front. When rod 48 moved to the left or right (i.e. FIGS. 8E, 8F) mandrel 394 (FIG. 11) rotates slightly and connecting shaft 392 is jerked appreciably.

Lever 48 can thus be moved to the left or to the right (as viewed in FIG. 11) causing shaft 392 to pivot the four-way gear box 85 in a plane perpendicular to the biaxial plane. However, lever 48 may also be moved inwardly or outwardly (i.e. defining an arc perpendicular to the biaxial plane) which steers the trowel in generally "fore" and "aft" directions, as seen by the large arrows in FIGS. 8A through 8D. For this reason the crank system 434 is employed, since the latter compensates for the changes in linkage radii when pivoting occurs in the other plane.

Lever arm 364 is coupled by its clevis 374 to ball and socket joint 408 coupled to joint 414 by shaft 409 (FIG. 13). Lever 50 is welded at its bottom to mandrel 403 which is captivated by axle 402. Lever 50 terminates beneath the frame deck 34 in control link 412 which in turn couples to ball and socket joint 414. Therefore when lever 50 is moved toward or away from the front of the trowel (FIGS. 8C, 8E) lever arm 364 is respectively titled downwardly or upwardly as link 412 moves axially away or toward the front.

Preferably a flatness indicator system is provided for measuring the pitch or profile of the surface 26 being worked. Lever arm 50 includes a pointer 401 (FIGS. 11, 13, 17) which projects toward a gauge 442 of generally semi-circular profile formed on the top surface of strut 343. The face of gauge 442 is marked to provide an indication of the inclination of the lower surface. In other words, where the trowel is driven over a particular region of the surface to be treated, when the operator releases lever 50 natural tilting forces on the rotors will deflect the lever 50 and its pointer 401 registers the inclination against gauge 442, which is visible to the operator. In use it has been found best to observe the gauge during limited sideways movements selected by lever 48, as illustrated in FIG. 8F. When lever 48 is thereafter deflected by surface irregularities, the rough areas (i.e. those which need the most treatment) will be indicated by deflection of gauge pointer 401.

Ball and socket joints 381 and 384 contain a pivot ball as part of their design. This pivot ball is hollow so that a shaft may be inserted through it. With a shaft contained the ball will allow a shaft to move in a conical range with approximately 15° from center line before the shaft comes in contact with the outer face. When torque rods 382 and 386 exceed this angle, torque is transferred to lever arms 364, 366. As they are welded to mandrels 369 at their ends, and since mandrels 365 are rigidly maintained in the critical direction by shaft 360, a twist is imparted to both lever arms as torque rods 382 and 386 are moved up or down past 15°. This imparts a quick return to rotor assemblies 54 and 56 and is detected in primary steering control levers 48 and 50 in the form of a faster response. An even quicker response can be anticipated if the ball is fixed on center. This can be accomplished by spot welding the ball to the outer housing.

Figure 8A:
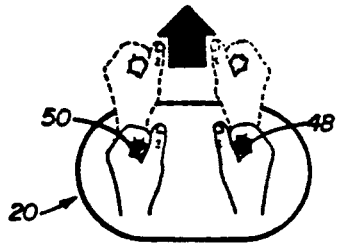
FIGS. 8A through 8F abbreviated diagrammatic views illustrating steering lever action and steering response of our Fast Steering Riding Trowel, with the starting position of the operator's hands illustrated in solid lines, and with large arrows pictorially illustrating resultant trowel displacement.
Figure 8B:
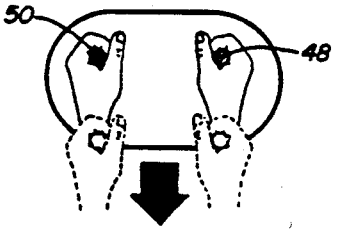
Figure 8C:
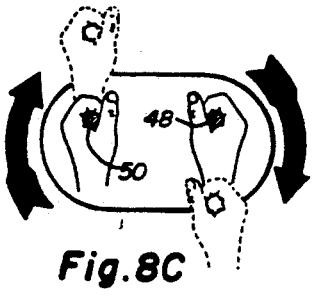
Figure 8D:
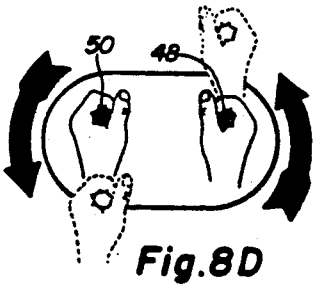
Figure 8E:
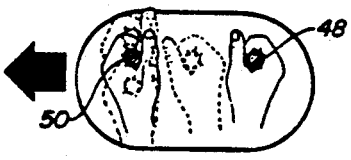
Figure 8F:
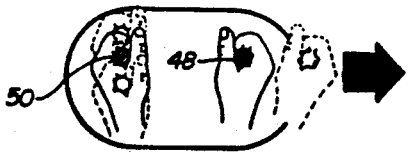

Operation commences as in FIGS. 8A through 8F. FIG. 8B illustrates levers 50 and 48 pulled rearwardly in unison an equal distance. Gear box 85 is pivoted on bolts 222 and gear box 85A is pivoted on bolts 250 upward thus moving shafts 102 (FIG. 17) inward. By this means the rotor blade assemblies 54 and 56 are tilted away from one another resulting in a rearward movement of trowel machine 20 on surface 26.

It is now apparent, by the explanation of forward and rearward steering, that in FIGS. 8C and 8D circular movement of machine 20 is accomplished by tilting one rotor assembly to the outside while the other is tilted to the inside. In FIGS. 8E and 8F steering to the right or left is indicated. Steering lever 48 serves to pivot gearbox 85 forward or rearward on the axis of bolt 230 (FIG. 10) as well as to the inside or outside. Forward or rearward tilting of gearbox 85 while gearbox 85A is held on a level plane results in machine movement to the right or left. A slight movement of steering lever 50 forward or rearward is necessary on unlevel surfaces in order to go straight left or right.

In FIG. 8A steering levers 50 and 48 are moved forward in unison an equal distance, pivoting gear box 85 on bolts 222 and gear box 85A on bolts 250 downward, thus moving shafts 102 (FIG. 17) outward. By this means differential frictional forces generated by the clockwise rotation of blades on rotor assembly 56 and the counter clockwise rotation of blades on rotor assembly 54 (shown in dashed arrows in FIG. 17) pull the trowel forwardly.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means, said frame means comprising a front and a rear;

motor means for powering said riding trowel;

rotor means comprising a pair of rotors associated with said frame means for frictionally contacting said concrete surface and supporting said frame means thereabove;

gearbox means for driving said rotor means, said gearbox means comprising a pair of separator gearboxes each having rotatable shafts projecting downwardly from said frame means and together defining a biaxial plane;

pivot steering box means for pivotally mounting said gearbox means to said frame means, said pivot steering box means comprising an individual pivot steering box for each of said last mentioned gear boxes, one of said last mentioned pivot steering boxes pivoting its gearbox in planes both parallel with and perpendicular to said biaxial plane, the other of said last mentioned pivot steering boxes pivoting its gear box only in a plane perpendicular to said biaxial plane;

drive shaft means for actuating said gearbox means in response to said motor means thereby revolving said rotor means; and, lever arm means disposed beneath said frame means for tilting said rotor means in response to said primary control lever means, said lever arm means comprising a pair of individual, parallel lever arms rotatably coupled to said frame means beneath said frame means rear and extending substantially to said frame means front;

offset torque rod means extending between said lever arm means and said gearbox means for tilting said rotor means in a plane generally parallel with said biaxial plane;

connecting shaft means for tilting at least one of said rotors in a plane generally perpendicular to said biaxial plane.

2. The riding trowel as defined in claim 1 wherein a perpendicular pivot axis is established by said pivot steering boxes, and said torque rod means is offset from last mentioned axis.

3. The riding trowel as defined in claim 1 wherein said lever arms are rotatably coupled to said frame means beneath said frame means rear by knuckle spring means restrained on shaft means associated with said frame means.

4. The riding trowel as defined in claim 1 wherein said connecting shaft means is interconnected with said one of said rotor means by tertiary linkage means for deriving a mechanical advantage.

5. The riding trowel as defined in claim 1 wherein said trowel comprises a flatness indicator system for indicating the pitch of the concrete surface being treated.

6. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means, said frame means comprising a front and a rear;

motor means for powering said riding trowel;

twin rotor means associated with said frame means for navigating said concrete surface and supporting said frame means thereabove, each rotor means comprising:

blade means comprising a plurality of individual radially spaced apart blades adapted to frictionally contact said surface, said blades having a preselected pitch;

gearbox means for rotating said blade means, said gearbox means comprising a pair of rotatable shafts projecting downwardly from said frame means and defining a biaxial plane; and, pivot steering box means for pivotally mounting said gearbox means to said frame means;

flexible drive shaft means for actuating said gearbox means in response to said motor means thereby revolving said rotor means;

means interconnecting said drive shaft means with said motor means;

lever arm means disposed beneath said frame means for tilting said gearbox means in a plane generally parallel with said biaxial plane in response to said primary control lever means, said lever arm means comprising a pair of individual, elongated and parallel lever arms rotatably coupled to said frame means beneath said frame means rear and extending substantially to said frame means front bisecting the frame.

7. The riding trowel as defined in claim 6 wherein a perpendicular pivot axis is established by said pivot steering means, and said trowel comprises torque rod means is offset from last mentioned axis.

8. The riding trowel as defined in claim 6 wherein said lever arms are rotatably coupled to said frame means beneath said frame means rear by knuckle spring means restrained on shaft means associated with said frame means.

9. The riding trowel as defined in claim 20 including electric linear actuator means for automatically varying said pitch of said blades.

10. A self-propelled, riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering sad riding trowel;

rotor means associated with said frame means and supporting said frame means thereabove, said rotor means comprising a plurality of blades for frictionally contacting said concrete surface;

gearbox means for driving said rotor means, said gearbox means comprising a pair of rotatable shafts projecting downwardly from said frame means and together defining a biaxial plane;

means for pivotally mounting said gearbox means to said frame means;

drive shaft means for actuating said gearbox means in response to said motor means thereby revolving said rotor means;

means for tilting said rotor means for steering said trowel, said means for tilting comprising a pair of elongated, cooperating parallel lever arms rotatably coupled to said frame means beneath said frame means rear and extending from said rear to the front of said frame means; and, flatness indicator means for determining surface pitch, said flatness indicator means comprising a pointer emanating from said primary control lever means and a gauge face defined in said frame means.

11. The riding trowel as defined in claim 10 wherein said drive shaft means is flexible, and comprises friction disk means for flexing said drive shaft means.

12. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

rotor means associated with said frame means and supporting said frame means thereabove, said rotor means comprising a plurality of blades for frictionally contacting said concrete surface;

gearbox means for driving said rotor means, said gearbox means comprising a pair of rotatable shafts projecting downwardly from said frame means and together defining a biaxial plane;

pivot steering box means for pivotally mounting said gearbox means to said frame means;

drive shaft means for actuating said gearbox means in response to said motor means thereby revolving said rotor means;

lever arm means disposed beneath said frame means for tilting said rotor means for steering, said lever arm means comprising a pair of individual, parallel lever arms rotatably coupled to said frame means beneath said frame means rear and extending substantially to said frame means front;

means for varying the pitch of said blades; and, gauge means for indicating blade pitch, said gauge means comprising a pointer emanating from said primary control lever means and a gauge face defined in said frame means.

13. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

rotor means associated with said frame means for frictionally contacting said concrete surface and supporting said frame means thereabove, said rotor means comprising at least two rotors;

gearbox means for driving said rotor means, said gearbox means comprising a pair of rotatable shafts projecting downwardly from said frame means and together defining a biaxial plane, wherein said gearbox means comprises a separate gearbox for each of said rotors;

pivot steering box means for pivotally mounting said gearbox means to said frame means, said pivot steering box means comprising an individual pivot steering box for each of said last mentioned gear boxes, wherein one of said last mentioned pivot steering boxes pivots its gearbox in planes both parallel with and perpendicular to said biaxial plane, the other of said last mentioned pivot steering boxes pivots its gear box only in a plane perpendicular to said biaxial plane, and wherein one of said pivot steering boxes establishes a perpendicular pivot axis for tilting in a plane perpendicular to said biaxial plane;

drive shaft means for actuating said gearbox means in response to said motor means thereby revolving said rotor means;

lever arm means rotatably coupled to said frame means beneath said frame means rear for tilting said rotor means in response to said primary control lever means, wherein said lever arm means comprises torque rod means extending between it and said gear box means for tilting said rotors in a plane parallel to said biaxial plane, and wherein said torque rod means is offset from last mentioned axis; and, connecting shaft means actuated by said lever arm means for tilting one of said rotor means in a plane generally perpendicular to said biaxial plane, said connecting shaft means interconnected with said one of said rotor means by tertiary linkage means for deriving a mechanical advantage.

14. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

rotor means associated with said frame means for frictionally contacting said concrete surface and supporting said frame means thereabove;

gearbox means for driving said rotor means, said gearbox means comprising a pair of rotatable shafts projecting downwardly from said frame means and together defining a biaxial plane;

pivot steering box means for pivotally mounting said gearbox means to said frame means;

drive shaft means for actuating said gearbox means in response to said motor means, thereby revolving said rotor means;

friction disk means for flexing said drive shaft means;

lever arm means disposed beneath said frame means for tilting said rotor means in response to said primary control lever means; and, torque rod means extending between said lever arm means and said gearbox means for tilting said rotor means in a plane generally parallel with said biaxial plane.

15. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

twin rotor means associated with said frame means for navigating said concrete surface and supporting said frame means thereabove, each rotor means comprising:

blade means comprising a plurality of individual radially spaced apart blades adapted to frictionally contact said surface, said blades having a preselected pitch;

gearbox means for rotating said blade means, said gearbox means comprising a pair of rotatable shafts projecting downwardly from said frame means and defining a biaxial plane; and pivot steering box means for pivotally mounting said gearbox means to said frame means;

flexible drive shaft means for actuating said gearbox means in response to said motor means thereby revolving said rotor means, said flexible drive shaft means comprising individual shaft sections axially linked together by friction disk means for facilitating bending;

means interconnecting said drive shaft means with said motor means; and, lever arm means disposed beneath said frame means for tilting said gearbox means in a plane generally parallel with said biaxial plane in response to said primary control lever means.

16. The riding trowel as defined in claim 15 wherein one of said pivot steering boxes pivots its gearbox in planes both parallel with and perpendicular to said biaxial plane, the other of said last mentioned pivot steering boxes pivots its gear box only in a plane parallel with said biaxial plane.

17. The riding trowel as defined in claim 16 wherein said lever arm means comprises torque rod means coupled to said gearbox means for tilting said gearbox means in a plane generally parallel with said biaxial plane.

18. The riding trowel as defined in claim 17 wherein a perpendicular pivot axis is established by said pivot steering boxes, and said torque rod means is offset from last mentioned axis.

19. The riding trowel as defined in claim 17 wherein said lever arm means is rotatably coupled to said frame means beneath said frame means rear.

20. The riding trowel as defined in claim 17 wherein said lever arm means is rotatably coupled to said frame means beneath said frame means rear by knuckle spring means restrained on shaft means associated with said frame means.

21. The riding trowel as defined in claim 17 wherein said primary control lever means comprises connecting shaft means for tilting one of said rotor means in a plane generally perpendicular with the biaxial plane.

22. The riding trowel as defined in claim 21 wherein said connecting shaft means is interconnected with said one of said rotor means by tertiary linkage means for deriving a mechanical advantage.

23. The riding trowel as defined in claim 22 wherein said tertiary linkage means comprises crank means driven by said connecting shaft means and coupled to said gearbox means by rigid

24. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said level means;

motor means for powering said riding trowel;

twin rotor means associated with said frame means for navigating said concrete surface and supporting said frame means thereabove, each rotor means comprising:

blade means comprising a plurality of individual radially spaced apart blades adapted to frictionally contact said surface, said blades having a preselected pitch;

gearbox means for rotating said blade means, said gearbox means comprising a pair of rotatable shafts projecting downwardly from said frame means and defining a biaxial plane; and, pivot steering box means for pivotally mounting said gearbox means to said frame means;

flexible drive shaft means for actuating said gearbox means in response to said motor means thereby revolving said rotor means;

means interconnecting said drive shaft means with said motor means;

lever arm means disposed beneath said frame means for tilting said gearbox means in a plane generally parallel with said biaxial plane in response to said primary control lever means; and, crank means for varying said pitch of said blades, and wherein said rotor means comprises means for twisting said blades about their longitudinal axis, clutch plate means for actuating said last mentioned means, fork means for selectively actuating said clutch plate means, and cable means interconnecting said hand crank means to said fork means.

25. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

twin rotor means associated with said frame means for navigating said concrete surface and supporting said frame means thereabove, each rotor means comprising:

blade means comprising a plurality of individual radially spaced apart blades adapted to frictionally contact said surface, said blades having a preselected pitch;

electric means for automatically varying said pitch of said blades;

gearbox means for rotating said blade means, said gearbox means comprising a pair of rotatable shafts projecting downwardly from said frame means and defining a biaxial plane; and, pivot steering box means for pivotally mounting said gearbox means to said frame means;

flexible drive shaft means for actuating said gearbox means in response to said motor means thereby revolving said rotor means;

means interconnecting said drive shaft means with said motor means;

lever arm means disposed beneath said frame means for tilting said gearbox means in a plane generally parallel with said biaxial plane in response to said primary control lever means.

26. The riding trowel as defined in claim 25 including crank means for manually varying the pitch of said blades, and wherein said rotor means comprises means for twisting said blades about their longitudinal axis, clutch plate means for actuating said last mentioned means, fork means for selectively actuating said clutch plate means, and cable means interconnecting said hand crank means to said fork means.

27. A self-propelled, riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

rotor means associated with said frame means and supporting said frame means thereabove, said rotor means comprising a plurality of blades for frictionally contacting said concrete surface;

gearbox means for driving said rotor means, said gearbox means comprising a pair of rotatable shafts projecting downwardly from said frame means and together defining a biaxial plane;

torque rod means extending to said gearbox means for tilting said rotor means in a plane generally parallel with said biaxial plane;

means for pivotally mounting said gearbox means to said frame means;

drive shaft means for actuating said gearbox means in response to said motor means thereby revolving said rotor means;

means for tilting said rotor means for steering said trowel, said means comprising elongated lever arms rotatably coupled to said frame means beneath said frame means rear; and, flatness indicator means for determining surface pitch.

28. The riding trowel as defined in claim 27 wherein said primary control lever means comprises connecting shaft means for tilting one of said rotor means in a plane generally perpendicular to said biaxial plane.

29. The riding trowel a defined in claim 28 wherein said connecting shaft means is interconnected with said one of said rotor means by tertiary linkage means for deriving a mechanical advantage.

30. The riding trowel as defined in claim 29 wherein said tertiary linkage means comprises crank means driven by said connecting shaft means and coupled to said gearbox means by rigid rod means.

31. A self-propelled, riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

rotor means associated with said frame means and supporting said frame means thereabove, said rotor means comprising a plurality of blades for frictionally contacting said concrete surface;

gearbox means for driving said rotor means, said gearbox means comprising a pair of rotatable shafts projecting downwardly from said frame means and together defining a biaxial plane;

means for pivotally mounting said gearbox means to said frame means;

flexible drive shaft means for actuating said gearbox means in response to said motor means thereby revolving said rotor means, said drive shaft means comprising friction disk means for flexing said drive shaft means;

means for tilting said rotor means for steering said trowel; and, flatness indicator means for determining surface pitch.

32. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

rotor means associated with said frame means and supporting said frame means thereabove, said rotor means comprising a plurality of blades for frictionally contacting said concrete surface;

gearbox means for driving said rotor means, said gearbox means comprising a pair of rotatable shafts projecting downwardly from said frame means and together defining a biaxial plane;

pivot steering box means for pivotally mounting said gearbox means to said frame means, said pivot steering box means establishing a perpendicular pivot axis;

drive shaft means for actuating said gearbox means in response to said motor means thereby revolving said rotor means;

lever arm means disposed beneath said frame means and rotatably coupled to said frame means beneath said frame means rear for tilting said rotor means for steering;

torque rod means extending between said lever arm means and said gearbox means for tilting said rotor means in a plane generally parallel with said biaxial plane to steer, said torque rod means being offset from a perpendicular pivot axis of said pivot steering box means;

means for varying the pitch of said blades; and, gauge means for indicating blade pitch.

33. A self-propelled, fast steering motorized riding trowel for finishing a concrete surface, said riding trowel having a front and comprising:

seat means for supporting an operator of said riding trowel;

primary control lever means accessible by said operator from said seat means at said front for steering said riding trowel;

rigid frame means adapted to be disposed over said concrete surface for supporting said seat means and said lever means;

motor means for powering said riding trowel;

twin rotor means associated with said frame means for supporting said frame means thereabove, each rotor means comprising a plurality of rotatable blades frictionally contacting said surface;

gearbox means for driving each rotor means, each gearbox means comprising a pair of rotatable shafts projecting downwardly from said frame means and together defining a biaxial plane;

a pivot steering box means for pivotally mounting each gearbox means to said frame means;

drive shaft means for actuating each gearbox means in response to said motor means thereby revolving said rotor means;

friction disk means for flexing said drive shaft means;

lever arm means disposed beneath said frame means for steering in response to said primary control lever mean;

torque rod means extending between said lever arm means and each gearbox means for tilting each rotor means in a plane parallel with said biaxial plan in response to said lever arm means; and, connecting shaft means for tilting one of said rotor means in a plane generally perpendicular to said biaxial plane.

34. A self-propelled, fast steering motorized riding trowel for finishing a concrete surface, said riding trowel having a front and comprising;

seat means for supporting an operator of said riding trowel;

primary control lever means accessible by said operator from said seat means at said front for steering said riding trowel;

rigid frame means adapted to be disposed over said concrete surface for supporting said seat means and said lever means;

motor means for powering said riding trowel;

a flatness indicator system for indicating the pitch of the concrete surface being treated;

twin rotor means associated with said frame means for supporting said frame means thereabove, each rotor means comprising a plurality of rotatable blades frictionally contacting said surface, said blades defining a predetermined pitch, said rotor means comprising means for twisting said blades about their longitudinal axis, clutch plate means for actuating said last mentioned blade-twisting means, fork means for selectively actuating said clutch plate means, and cable means interconnecting said hand crank means to said fork means;

crank means for varying said pitch of said blades;

means for indicating said pitch of said blades;

a gearbox means for driving each rotor means, each gearbox means comprising a pair of rotatable shafts projecting downwardly from said frame means and together defining a biaxial plane;

a pivot steering box means for pivotally mounting each gearbox means to said frame means;

drive shaft means for actuating each gearbox means in response to said motor means thereby revolving said rotor means;

friction disk means for flexing said drive shaft means;

lever arm means disposed beneath said frame means for steering in response to said primary control lever means;

torque rod means extending between said lever arm means and each gearbox means for tilting each rotor means in a plane parallel with said biaxial plane in response to said lever arm means; and, connecting shaft means for tilting one of said rotor means in a plane generally perpendicular to said biaxial plane.

35. A self-propelled, fast steering motorized riding trowel for finishing a concrete surface, said riding trowel comprising:

seat means for supporting an operator of said riding trowel;

primary control lever means accessible by said operator from said seat means for steering said riding trowel;

rigid frame means adapted to be disposed over said concrete surface for supporting said seat means and said lever means;

motor means for powering said riding trowel;

friction disk means for flexing said drive shaft means;

a flatness indicator system for indicating the pitch of the concrete surface being treated;

rotor means associated with said frame means for frictionally contacting said concrete surface and supporting said frame means thereabove;

gearbox means for driving said rotor means, said gearbox means comprising a pair of rotatable shafts projecting downwardly from said frame means and together defining a biaxial plane;

pivot steering box means for pivotally mounting said gearbox means to said frame means;

drive shaft means for actuating said gearbox means in response to said motor means thereby revolving said rotor means;

lever arm means disposed beneath said frame means for tilting said rotor means in response to said primary control lever means, said lever arm means rotatably coupled to said frame means beneath said frame means rear and comprising torque rod means extending between it and said gear box means for tilting said rotor means in a plane parallel with said biaxial plane; and, wherein a perpendicular pivot axis is established by said pivot steering boxes, and said torque rod means is offset from last mentioned axis.

* * * * *